US009592890B2

(12) United States Patent
Christensen et al.

(10) Patent No.: US 9,592,890 B2
(45) Date of Patent: Mar. 14, 2017

(54) TOWROPE WINCH RIDER PROFILE

(75) Inventors: Ladd E. Christensen, Holladay, UT (US); John M. Welch, American Fork, UT (US); Tyson Triplett, Provo, UT (US); Devin Hales, Lehi, UT (US)

(73) Assignee: GLOBAL INNOVATIVE SPORTS INCORPORATED, Holladay, UT (US)

( * ) Notice: Subject to any disclaimer, the term of this patent is extended or adjusted under 35 U.S.C. 154(b) by 221 days.

(21) Appl. No.: 12/689,082

(22) Filed: Jan. 18, 2010

(65) Prior Publication Data

US 2010/0121493 A1 May 13, 2010

Related U.S. Application Data

(63) Continuation-in-part of application No. 11/069,615, filed on Feb. 28, 2005, now Pat. No. 7,665,411.

(60) Provisional application No. 60/599,273, filed on Aug. 6, 2004.

(51) Int. Cl.
*B63B 21/16* (2006.01)
*B63B 35/81* (2006.01)

(52) U.S. Cl.
CPC ..... *B63B 35/816* (2013.01)

(58) Field of Classification Search
CPC ..... B63B 21/16
USPC ..... 700/275; 254/271; 114/275, 254; 440/84; 340/984
See application file for complete search history.

(56) References Cited

U.S. PATENT DOCUMENTS 3,098,463 A * 7/1963 Brown ..... 114/254
3,100,606 A 8/1963 Nicholson
3,178,127 A 4/1965 Andersen
3,261,302 A 7/1966 Forsman
3,303,813 A 2/1967 Collins et al.
3,315,914 A 4/1967 Turner
3,398,715 A 8/1968 Burg
3,547,371 A 12/1970 Gruseck
3,643,886 A 2/1972 Colton
3,738,589 A 6/1973 Brayman
(Continued)

FOREIGN PATENT DOCUMENTS

JP 07-215687 8/1995
JP 2000-095184 4/2000
(Continued)

OTHER PUBLICATIONS

Non-Final Office Action, U.S. Appl. No. 11/069,615, Apr. 20, 2006.
(Continued)

*Primary Examiner* — Tejal Gami
(74) *Attorney, Agent, or Firm* — Workman Nydegger

(57) ABSTRACT

A system for controlling a towrope winch may comprise a computing device configured to send and receive data to and from the towrope winch, and a towrope winch application configured to operate on the computing device, in which the computing device is configured to operate the towrope winch based on data inputted by the user to the towrope winch application. A towrope winch user interface may comprise a processor configured to send and receive data to and from a towrope winch, and a towrope winch application configured to operate with the processor, in which the processor is configured to operate the towrope winch based on data inputted by the user to the towrope winch application.

20 Claims, 17 Drawing Sheets

(56) References Cited

U.S. PATENT DOCUMENTS

| | | | | |
|---|---|---|---|---|
| 3,742,490 | A | 6/1973 | Henderson | |
| 3,780,989 | A | 12/1973 | Peterson | |
| 3,798,631 | A | 3/1974 | Langford | |
| 3,919,963 | A | 11/1975 | Cox, III | |
| 3,964,425 | A | 6/1976 | Septor, Sr. | |
| 4,133,496 | A | 1/1979 | Zetah | |
| 4,237,997 | A | 12/1980 | Swanson | |
| 4,237,999 | A | 12/1980 | Batreau | |
| 4,274,605 | A | 6/1981 | Gruber, Jr. | |
| 4,356,557 | A | 10/1982 | Bell et al. | |
| 4,624,141 | A | 11/1986 | Soleau | |
| 5,119,751 | A | 6/1992 | Wood | |
| 5,167,550 | A * | 12/1992 | Nielsen | 440/84 |
| 5,341,758 | A | 8/1994 | Strickland | |
| 5,408,221 | A | 4/1995 | Carsella et al. | |
| 5,632,219 | A | 5/1997 | Fleming, Jr. | |
| 5,694,337 | A | 12/1997 | Macken | |
| 5,732,648 | A | 3/1998 | Aragon | |
| 5,794,883 | A | 8/1998 | MacEwen | |
| 5,906,170 | A | 5/1999 | Robertson | |
| 5,943,977 | A | 8/1999 | Womack et al. | |
| 5,979,350 | A | 11/1999 | Larson et al. | |
| 5,982,126 | A | 11/1999 | Hellinga et al. | |
| 6,102,373 | A | 8/2000 | Amsinger | |
| 6,138,397 | A | 10/2000 | Hammersland et al. | |
| 6,192,819 | B1 | 2/2001 | Larson et al. | |
| 6,312,301 | B1 | 11/2001 | Kennedy | |
| 6,505,573 | B1 | 1/2003 | Sheikholeslam et al. | |
| 6,672,238 | B2 | 1/2004 | Sheikholeslam et al. | |
| 6,822,572 | B2 | 11/2004 | Lentine et al. | |
| 6,886,812 | B2 | 5/2005 | Kazerooni | |
| 6,997,442 | B2 | 2/2006 | Hoffend | |
| 7,299,761 | B2 | 11/2007 | Larson et al. | |
| 7,665,411 | B2 | 2/2010 | Welch | |
| 8,220,405 | B2 | 7/2012 | Christensen et al. | |
| 8,651,461 | B2 | 2/2014 | Christensen et al. | |
| 2003/0010272 | A1 * | 1/2003 | Sheikholeslam et al. | 114/254 |
| 2003/0164777 | A1 * | 9/2003 | Lentine et al. | 340/984 |
| 2003/0220835 | A1 * | 11/2003 | Barnes, Jr. | 705/14 |
| 2003/0233449 | A1 | 12/2003 | Bonilla et al. | |
| 2006/0027155 | A1 | 2/2006 | Welch | |
| 2007/0272906 | A1 | 11/2007 | Davidson | |
| 2008/0083363 | A1 | 4/2008 | Hart | |
| 2008/0128668 | A1 | 6/2008 | Fofonoff et al. | |
| 2010/0114381 | A1 | 5/2010 | Welch et al. | |
| 2010/0211239 | A1 | 8/2010 | Christensen et al. | |
| 2010/0224117 | A1 | 9/2010 | Christensen et al. | |
| 2012/0279433 | A1 | 11/2012 | Christensen et al. | |

FOREIGN PATENT DOCUMENTS

| | | | |
|---|---|---|---|
| JP | 2004-504903 | A | 2/2004 |
| KR | 1020070004867 | A | 1/2007 |
| KR | 1020080091479 | A | 10/2008 |
| WO | 2007-073155 | | 6/2007 |
| WO | 2010-014048 | | 2/2010 |

OTHER PUBLICATIONS

Notice of Allowance, U.S. Appl. No. 11/069,615, Aug. 20, 2009.
Office Action, U.S. Appl. No. 12/782,006, Jul. 5, 2011.
Final Office Action, U.S. Appl. No. 12/782,006, Dec. 13, 2011.
Notice of Allowance, U.S. Appl. No. 12/782,006, Mar. 16, 2012.
Office Action, U.S. Appl. No. 12/621,442, Apr. 24, 2012.
Office Action, U.S. Appl. No. 12/710,337, Oct. 10, 2012.
Non-Final Office Action, U.S. Appl. No. 12/621,442, Jan. 3, 2013.
Office Action, U.S. Appl. No. 12/781,658, Jan. 22, 2013.
Non-Final Office Action, U.S. Appl. No. 13/549,065, Jun. 7, 2013.
Notice of Allowance, U.S. Appl. No. 12/781,658, Jun. 12, 2013.
Final Office Action, U.S. Appl. No. 12/621,442, Jul. 15, 2013.
Final Office Action, U.S. Appl. No. 12/710,337, Aug. 14, 2013.
Office Action, U.S. Appl. No. 13/549,065, Oct. 25, 2013.
Notice of Allowance cited in U.S. Appl. No. 13/549,065, dated Feb. 12, 2014.
Office Action cited in U.S. Appl. No. 12/621,442, dated May 7, 2014.
Office Action cited in U.S. Appl. No. 12/710,337, dated Mar. 21, 2014.

* cited by examiner

TOWROPE WINCH RIDER PROFILE

RELATED APPLICATIONS

The present application claims the benefit under 35 U.S.C. §119(e) of Provisional U.S. Patent Application No. 60/599,273, by John Merle Welch, filed Aug. 6, 2004, and entitled "Water Sport Towing Apparatus," and further claims the benefit under 35 U.S.C. §120 of Utility application Ser. No. 11/069,615, by John Welch, filed Feb. 28, 2005, and entitled "System and Method for a Tow Rope Retraction Device for Watercraft." These applications are incorporated herein by reference in their entirety.

BACKGROUND

Water sports such as wakeboarding, wakeskating, skurfing, wake surfing, and knee boarding have become increasingly popular. Due to the popularity of such water sports, new technology has been developed to enhance the participant's experience.

Particularly, several measures have been taken to increase the size of the wake made by the watercraft that is towing a wake boarder or other type of water sport enthusiast, such as a wake skater, wake surfer, or tuber. The size of the wake, which is the track left by a moving watercraft in the water, can determine how enjoyable the experience is for the user being towed. The higher and more voluminous the wake is, the greater vertical lift a wake boarder or watercraft sport enthusiast can achieve when moving over and springing off of the wake. With this greater vertical lift, the user can perform tricks and stunts that would not be possible with a smaller wake.

One way in which the wake is made bigger is by adding large amounts of weight to the boat or watercraft. This is often achieved by adding a water ballast system to the inside of the watercraft. A water ballast system will take on water when desired to cause the watercraft to ride lower and sink farther into the water, in other words, to increase the draft of the watercraft. When the watercraft then moves through the water, the increased draft causes the resulting wake to be larger.

While a ballast system does make a larger wake and does make it possible for the user to gain greater lift from the wake, it also has several disadvantages. For example, a ballast system causes the watercraft to experience a drastic decrease in fuel efficiency and handling, and creates all around greater wear and tear on the watercraft's mechanical parts.

In addition, ballast systems are generally only available in newer watercraft for the purpose of increasing wake size. Older watercraft do not have such ballast systems, and ballast systems are extremely difficult to retrofit to older watercraft. When a ballast system is added to an older watercraft, the result is usually not cost effective and outweighs the advantages of a having a larger wake obtained through installing such a ballast system.

Another way in which a user can enhance the vertical lift he or she can achieve over the wake of a watercraft is to include a tower on the watercraft. The towrope is then attached to the top of the tower. By increasing the distance between the surface of the water and the point at which the towrope is attached to the watercraft, the skier or boarder being towed can exert force, pulling upward on the towrope to achieve a greater vertical lift over the wake. The tower is typically a pylon or framework usually made of aluminum or other light metals.

Yet another way of enhancing the vertical lift a user can achieve over the wake of a watercraft is to increase the speed by which the user travels over the water, and especially the wake of the watercraft. An increase in velocity over a wake provides for more force to be exerted between the board the user is riding and the wake. One way to increase a rider's speed over a wake is to increase the speed of the watercraft pulling the rider. However, although the rider may employ audible or visual signals to the operator of the watercraft regarding the need for increased or decreased speed, communicating these messages may be cumbersome for the rider. This is because the rider may have to yell over other noises such as the noise of the engine of the watercraft, or may have to take a hand off the towrope in order to give a visual signal of some kind. This may cause the rider to become distracted or otherwise limit the rider's control as he or she is riding. Further, audible and visual communication with the operator of the watercraft takes the rider's ability to fully control his or her speed away, and creates and unpredictable situation where the rider may not anticipate the timing of the speed increase and degree of acceleration.

Another way to enhance the participant's experience is to allow the user to take advantage of the entire wake profile. Each wake made by a watercraft has a profile that is at its highest point immediately behind the watercraft and gradually reduces as the distance behind the watercraft increases. The wake profile is also dependant on the speed of the boat, the weight in the boat, the water conditions, etc. With a fixed tow line the participant can only take advantage of that section of the wake profile where he or she crosses the wake. If a participant had the capability to dynamically change where he or she intersected the wake it would greatly enhance the overall experience of the water sport session. Another way to enhance the participants experience would be to allow him or her the capability of riding along the top of the wake profile parallel to the watercraft.

Further, as alluded to above, when participating in the above-mentioned water sports, a rider may not be able to fully control various aspects of the riding conditions. This is because of the fact that the operator of the watercraft has unfettered control over rates of acceleration, direction of travel, and speeds of the watercraft at any given time. Also, changing some aspects of the riding conditions require that the watercraft be stopped in order to adjust. Thus, the rider has limited control over speeds, wake profile, and where he or she crosses the wake, among other riding conditions.

More specifically, one of the aspects that the rider does not have complete control over includes the length of the towrope from the attachment point on the watercraft. The length of the towrope may determine at what point in the wake the rider is riding. If the towrope is relatively short, then the rider can ride on the portion of the wake that is relatively larger since the wake is relatively larger immediately behind the watercraft. If the towrope is relatively long, then the rider can ride on a portion of the wake that is relatively smaller. Although in conventional systems, the rider may set the length of the towrope at a certain distance before and after a ride, the rider must remain at this length until he or she stops riding and adjusts the length. In other words, the rider cannot adjust the length of the towrope during a ride. If the rider had the option to dynamically change the distance that he/she could ride behind the watercraft then the rider could take advantage of the entire wake profile during a single riding session Another riding condition that the rider may not be able to fully control is the timing of when the watercraft starts from a dead stop and begins to initially pull the rider out of the water to a point at which the board the that rider is riding on is planing. This is called a dead start. In conventional systems, the operator of the watercraft simply causes the watercraft to start pulling the rider out of the water at a point in time that may not be anticipated by the rider. For example, the rider may give an audible or visual cue to the operator of the watercraft to begin pulling him or her from a dead start position, but the operator may not engage the watercraft until several seconds later. At this point the rider's body may be off balance, the riders board or ski may be in the wrong position, such as under the water, the riders grip on the towrope may have changed or a number of others things could have changed that lessen the chances of success for the rider to get out of the water and on plane.

Yet another riding condition that the rider may not be able to fully control is the speed and acceleration at which the watercraft pulls him or her out of the water from a dead stop. Riders of varying skill levels may prefer or require different rates of acceleration and speed when being pulled out of the water from a dead stop. For example, novice riders may require a slower rate of acceleration and initial speed from a dead start, whereas an expert or professional rider may prefer and be able to withstand higher rates of acceleration and speed when being pulled from a dead start. Also, the weight and size of the individual may change how the watercraft pulls a participant out of the water.

Still another riding condition that the rider may not have control over is in connection with wake surfing. In wake surfing the surfer typically uses a knotted rope that is much shorter than a wake boarding rope because the surfer surfs on the largest point of the wake profile immediately behind the watercraft. Once the surfer gets out of the water and is on plane the surfer pulls himself or herself, usually hand over hand with the knotted rope, to the point of the wake where he or she desires to surf. Once surfing begins, the surfer typically releases the knotted rope and surfs without the rope. The rope often dangles in the water, sometimes on top of the surfer's board, and is there until the surfer falls or ends the session. In some instances when the surfer falls the rope can become entangled in the surf board or in the surfer's body and lead to injury to the surfer or even possible drowning of the surfer. Also in order for the surfer to get to the point of the wake where he or she desires to surf, the rider must pull hand over hand along the rope. This requires a lot of strength and can cause the surfer's hands to become sore from the rope.

Finally, different riders have different skill levels and abilities with regard to different water sports. Riders may be classified as expert, intermediate, or novice riders, and may further have varying degrees there between. Further, an expert rider with regard to wakeboarding, for example, may not be at the same skill level when participating in other water sports such as wake surfing, wakeskating, or skurfing, for example. Further, as riders improve their skill level, adjustments may need to be made with regard to various aspects of the rider's experience. For example, a rider who improves his or her skill level may wish to experience faster riding speeds, faster or slower accelerations over the wake, or shorter or longer lengths of rope.

SUMMARY

A system for controlling a towrope winch may comprise a computing device configured to send and receive data to and from the towrope winch, and a towrope winch application configured to operate on the computing device, in which the computing device is configured to operate the towrope winch based on data inputted by the user to the towrope winch application. A towrope winch user interface may comprise a processor configured to send and receive data to and from a towrope winch, and a towrope winch application configured to operate with the processor, in which the processor is configured to operate the towrope winch based on data inputted by the user to the towrope winch application. A computer program product for defining operating parameters of a towrope winch, may comprise a computer usable medium having computer usable program code embodied therewith, the computer usable program code comprising computer usable program code configured to prompt a user to enter data, and computer usable program code configured to operate the towrope winch based on data inputted by the user.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Figure 1:
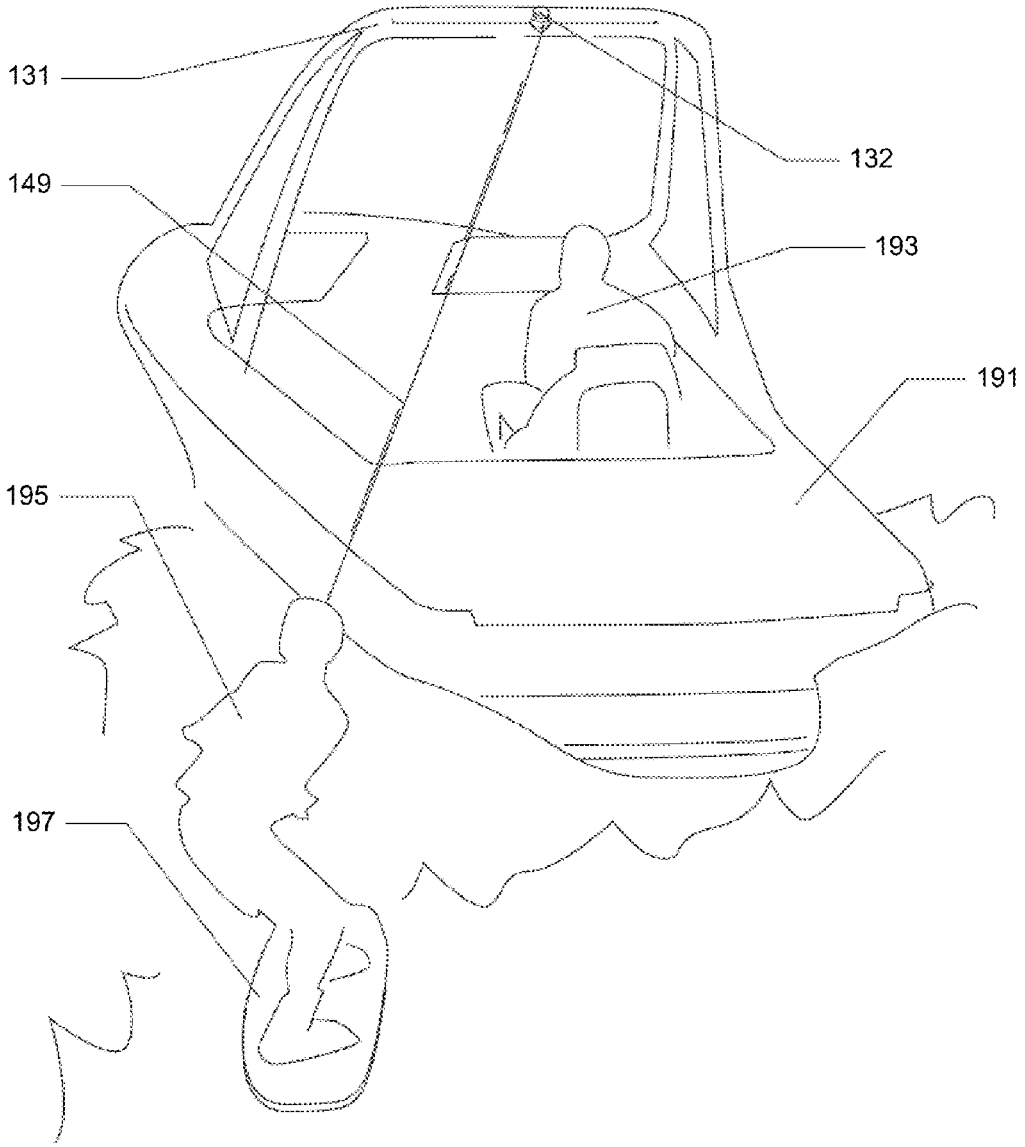
Prior Art Fig. 1
FIG. 1 is an illustrative depiction of a watercraft and towrope system according to teachings of the prior art.

Various systems and methods for controlling a tow system and watercraft via a user interface are disclosed herein. The user interface is used to provide a means for the user of the tow system to send and receive data to and from the tow system and the watercraft, as well as to other devices and networks. Through the interaction of the user interface and the tow system and watercraft, the user may be informed of the various operating parameters of the tow system and watercraft. Further, the user may also more fully control the operation of the tow system and watercraft, and create, update, and print rider and watercraft profiles, among others.

As used in the present specification and the appended claims, the term "watercraft" is meant to be understood broadly as any machine or device that may provide sufficient force to pull an object, including a rider, board, tube, etc. on water. A watercraft may include, for example, a personal watercraft (PWC), or a boat or ship of any kind. Further, as used in the present specification and the appended claims, the term "towrope" or "rope" is meant to be understood broadly as any rope attached to a watercraft, and used to pull any object, including a rider, board, tube, etc. behind the watercraft, and may be of any given length.

Still further, as used in the present specification and the appended claims, the term "board" is meant to be understood broadly as any object being utilized by a rider to plane on the surface of the water when being towed by a watercraft. Examples of a board may include skis, water skis, a wakeboard, a wakeskating board, a surfboard, a skurfing board, a kneeboard, a boogey board etc. Also, although a tube is not a board, per se, a tube and other devices may also be utilized by a rider to plane on the surface of the water when being towed by a watercraft.

Further, as used in the present specification and the appended claims, the term "winch" is meant to be understood broadly as any device that may change or adjust the length of rope between tow points. Examples of a winch may include a towrope winch used to change or adjust the length of the towrope between a watercraft and rider. Again, as used in the present specification and the appended claims, the term "tower" is meant to be understood broadly as any structure that extends above the deck of a watercraft to which a towrope is attached or belayed or to which a towrope retraction device is attached for the purpose of increasing the distance between the surface of the water and the connection point between the towrope and watercraft.

Further, as used in the present specification and the appended claims, the term "user interface" is meant to be understood broadly as any device, system of devices, computer code, or combinations thereof that may be utilized by a user in controlling the input and output of a computing system or other device. Examples of a user interface may include a graphical user interface (GUI), a keyboard, a mouse, a display device, a touch screen display device, a mobile telecommunications device, a personal digital assistant (PDA), a handheld computer, a laptop computer, a desktop computer, a web-based user interface, etc.

Still further, as used in the present specification and the appended claims, the term "page" or "web page" is meant to be understood broadly as any document or resource of information that is suitable for display by a computer application or via the Internet or an intranet, and can be accessed through a web browser and displayed on a display device.

Finally, as used in the present specification and the appended claims, the terms "application," "towrope winch application," "software," "firmware," or "computer usable program code" is meant to be understood broadly as any computer program code for carrying out operations of the present system that may be written in an object oriented programming language such as Java, Smalltalk, C++, etc., or in conventional procedural programming languages, such as the "C" programming language or similar programming languages. The program code may execute entirely on a user's computing device, partly on the user's computing device, as a stand-alone software package, partly on the user's computing device and partly on a remote computing device or entirely on the remote computing device or server, or other device such as a user interface device. In the latter scenario, the remote computing device may be connected to the user's computing device through a local area network (LAN) or a wide area network (WAN), or the connection may be made to an external computing device (for example, through the Internet using an Internet Service Provider).

FIG. 1 is an illustrative depiction of a watercraft and towrope system according to teachings of the prior art. While a boat is illustrated as the watercraft (191) in FIG. 1, it will be understood that the principles described herein can be applied to any watercraft (191) that can tow a rider (195) and any board (197) on water. As shown in FIG. 1, a tower (131) may be disposed on the watercraft (191). The tower (131) is connected to the watercraft (191) so as to be structurally sound enough to tow one or more riders (195). The tower (131) is usually made of a strong, lightweight material such as aluminum and may be a single pylon or a frame as depicted in FIG. 1.

A towrope (149) is attached to the top of the tower (131) so as to be attached to the towing watercraft (191) at a relatively greater height above the surface of the water. The towrope (149) is attached to the top of the tower by a hitch (132). The hitch (132) may be any apparatus that is configured to secure the towrope (149) to the tower (131), and may include, for example, a ball hitch, a cleat, a hook, a tow knob, or a ski tow eye.

Figure 2:
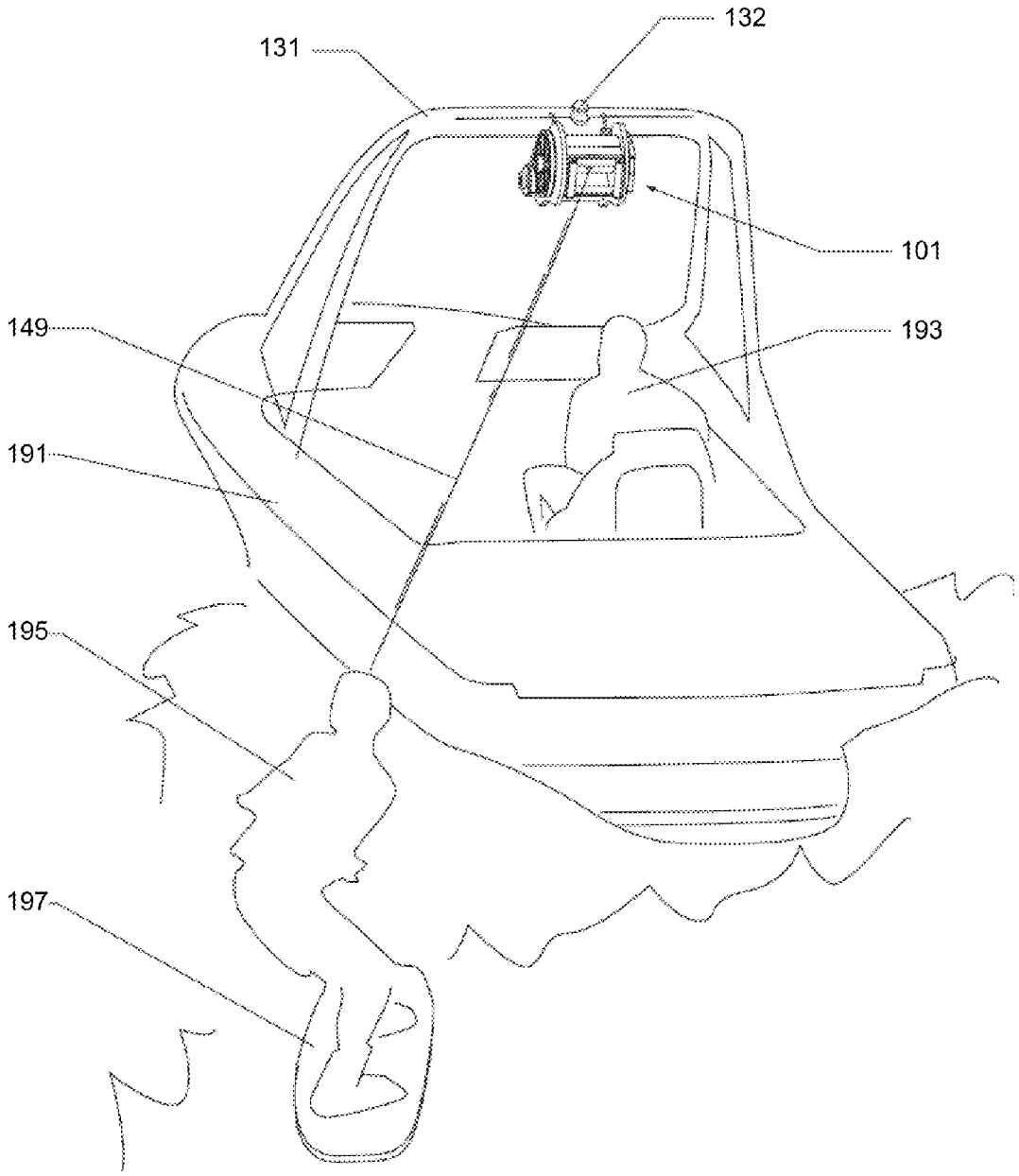
FIG. 2 is an illustrative depiction of a watercraft incorporating a towrope winch according to an embodiment of the present exemplary system and method.

Turning now to FIG. 2, an illustrative depiction of a watercraft (191) incorporating a towrope winch (101) according to an embodiment of the present exemplary system and method is depicted. In FIG. 2, the towrope winch (101) is attached at the top of the tower (131), and receives the towrope (149). Thus, as illustrated in FIG. 2, and described herein, the towrope (149) is not attached directly to the hitch (132) located on the tower (131), but is connected to the towrope winch (101) that is, in turn, attached to the tower (131). The towrope winch (101) can be positioned on the top of the tower (131) to increase the height above the surface of the water at which the towrope (149) is effectively connected to the watercraft (191). This provides additional vertical lift to the user as described above. It is also useful to place the towrope winch (101) at the top of the tower (131) so that the towrope (149) can be readily extended to the rider (195) unobstructed. However, it will be understood by those skilled in the art that the towrope winch (101) described herein need not be mounted on a tower, but may be mounted directly to the deck or other surface of the watercraft (191), and may utilize a pulley or other device at the tower (131).

In one exemplary embodiment, the towrope winch (101) may further include a housing. The housing protects the towrope winch (101) from contaminants such as water and dirt. Further, the housing may be configured to minimized or eliminate the risk of a user being injured by moving parts of the towrope winch (101) or entangling objects like hair or clothing in the towrope winch (101). Still further, the housing may include an aerodynamic design configured to reduce drag created by the presence of the towrope winch (101).

Generally, when the illustrated system is utilized, the rider (195) holds onto the towrope handle (FIG. 4, 198) as both the watercraft (191) and the rider (195) plane over the surface of the water. When the user passes over the wake, the towrope winch (101) may be activated to rapidly retract at least a portion of the towrope (149) and accelerate the rider (195) to provide greater vertical lift while jumping the wake of the watercraft (191).

In an exemplary embodiment, a leader cable may be connected to the towrope (149). The leader cable would be wound into the towrope winch (101) and would be made out of a stronger material so as to withstand the wear and tear that would occur as the line is wound into and reeled out by the towrope winch (101). This would extend the life of the towrope (149) by not having the towrope experience such wear and tear. In another exemplary embodiment, the towrope (149) may be made of a material that is flexible and lightweight enough to safely function as a towrope, but which is able to withstand the wear and tear that would occur as the towrope (149) is wound into and reeled out by the towrope winch (101). Further, the towrope (149) may be of any length. In one exemplary embodiment, the towrope (149) may be between 75 and 100 feet long.

In other exemplary embodiments, the towrope winch (101) need not be disposed atop the tower (131). The similar effect can be achieved by belaying the towrope through a pulley or other device on the tower (131). The towrope (149) then runs to the towrope winch (101) located somewhere else on the watercraft (191), perhaps attached to the deck of the watercraft (191).

Figure 3:
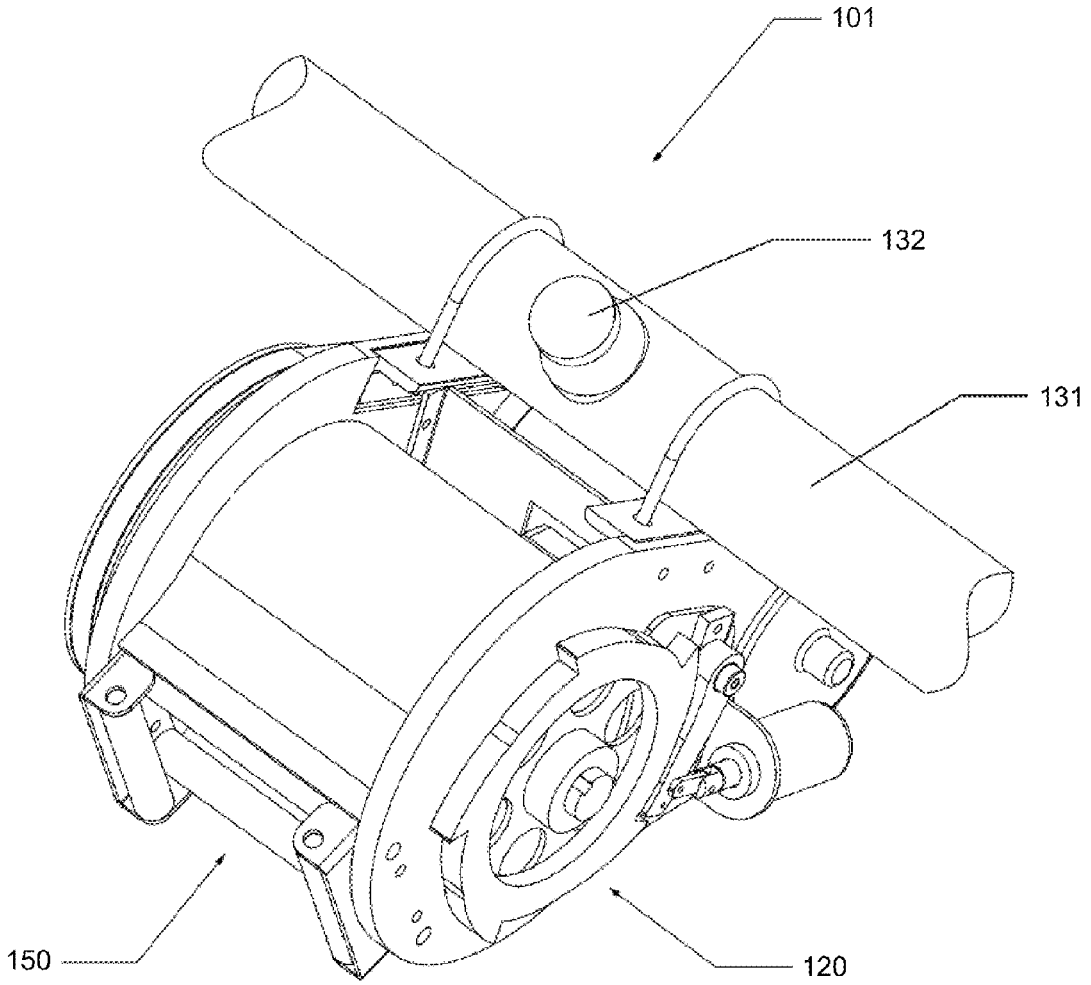
FIG. 3 is a perspective view of the towrope winch according to an embodiment of the present exemplary system and method.
Figure 4:
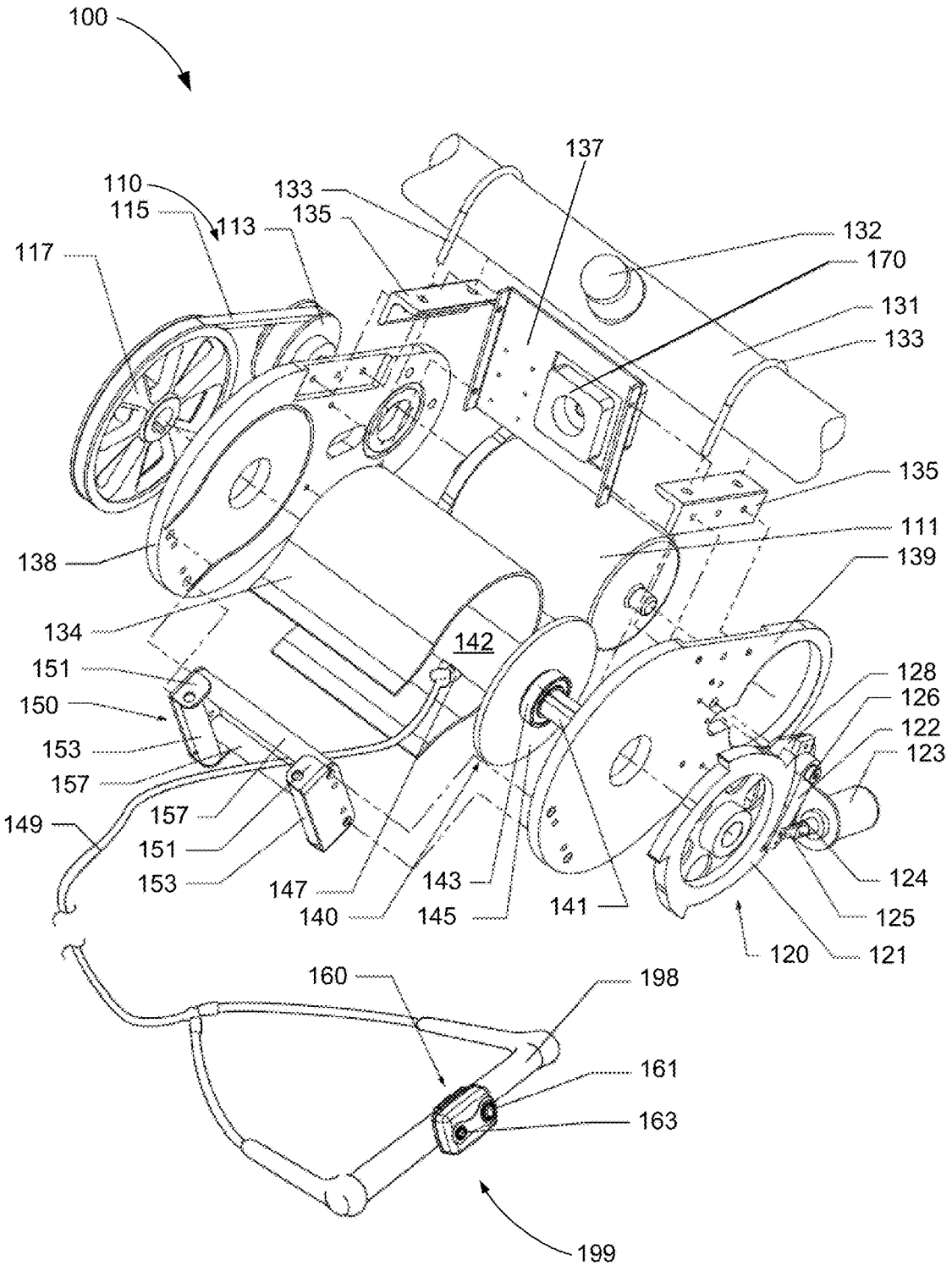
FIG. 4 is a perspective view of a tow system incorporating an exploded view of the towrope winch of FIG. 3, a towrope and towrope handle assembly according to an embodiment of the present exemplary system and method.

FIG. 3 is a perspective view of the towrope winch (101) according to an embodiment of the present exemplary system and method. As depicted in FIG. 3, the towrope winch (101) may be coupled to the tower (131). In an exemplary embodiment, the towrope winch (101) may be coupled to the tower (131) via a number of u-bolts (FIG. 4, 133) and a number of mounting plates (FIG. 4, 135). However, any coupling device or means to couple the towrope winch (101) to the tower (131) may be used.

FIG. 3 depicts a fairlead assembly (150) located at the end of the towrope winch (101) at which the towrope (FIG. 2, 149) is fed into the towrope winch (101). The fairlead assembly (150) guides the towrope (FIG. 2, 149) into the towrope winch (101), and prevents bunching or snagging of the towrope (FIG. 2, 149). Further, the fairlead assembly (150) also prevents chaffing or other forms of wear on the towrope (FIG. 2, 149). More specific details with regard to the fairlead assembly (150) will be discussed below. The towrope winch (101) also includes a brake assembly (120). Various braking systems may be used in the braking assembly (120) including, for example, an air brake system, a disc brake system, a disc brake system, a drum brake system, an electromagnetic brake system, or a hydraulic brake system. The brake assembly (120), when engaged, stops the towrope winch (101) from reeling a length of the towrope (FIG. 2, 149) in or out. In another exemplary embodiment, the brake assembly (120) may also be configured to slow the rate of towrope (FIG. 2, 149) feed in and out of the towrope winch (101). More specific details with regard to the brake assembly (120) will also be discussed below.

FIG. 4 is a perspective view of the tow system (100) incorporating an exploded view of the towrope winch (101) of FIG. 3, a towrope (149) and towrope handle assembly (199) according to an embodiment of the present exemplary system and method. As depicted in FIG. 4, the tow system (100) may include a towrope handle assembly (199), a towrope (149), a fairlead assembly (150), a reel assembly (140), a brake assembly (120), a brake chassis (139), a motor (111), a motor chassis (138), an electronic control unit (ECU) (170) and a tower (131). Each of these elements will be discussed in more detail below.

As depicted in FIG. 4, the tow system (100) further includes a towrope (149) and towrope handle assembly (199). The aspects of the towrope (149) are discussed in detail above, and will not be addressed here. However, the towrope handle assembly (199) may further include a towrope handle (198) and a towrope transmitter assembly (160). The towrope handle (198) may be any handle suitable for gripping by a rider (FIG. 2, 195).

Figure 9:
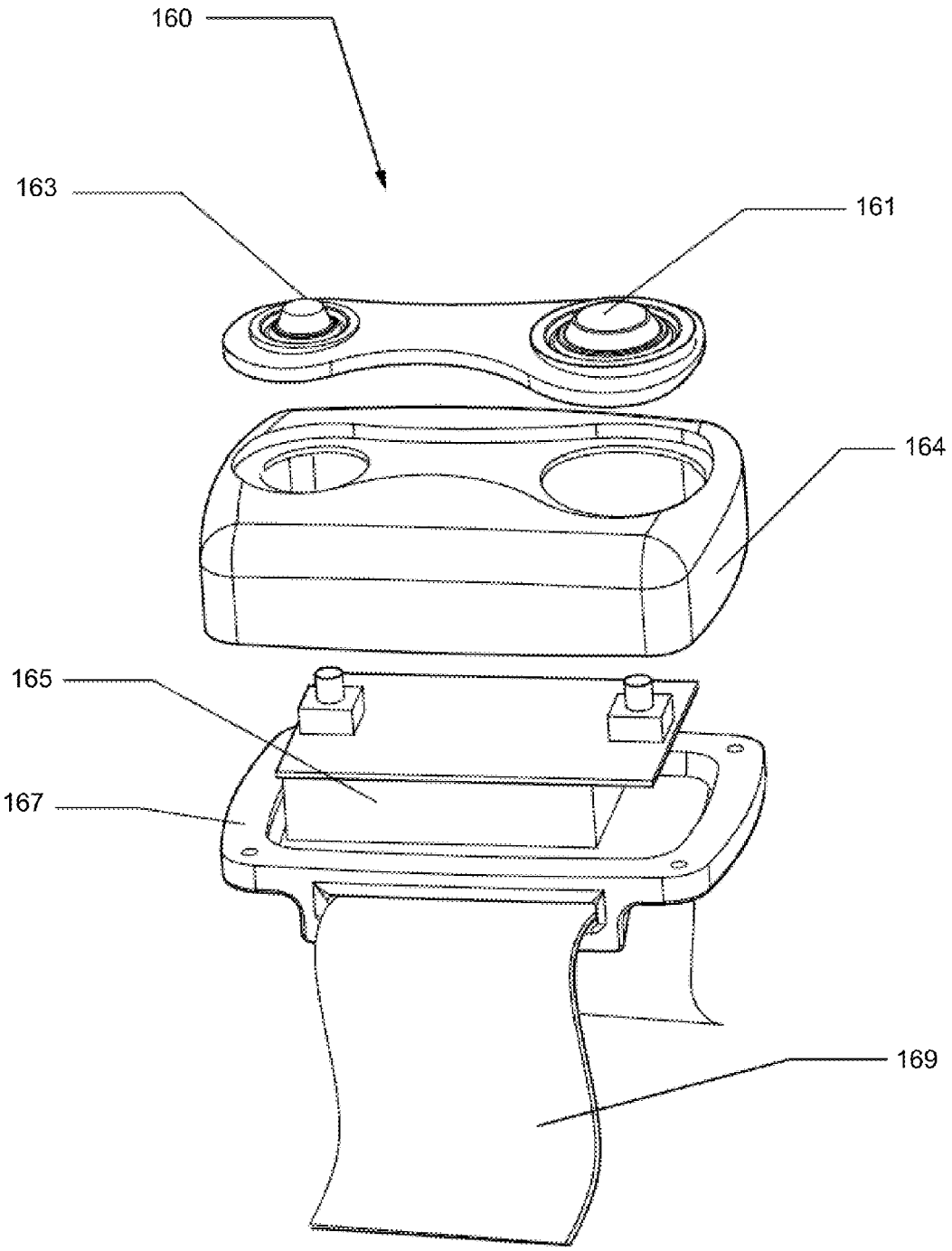
FIG. 9 is an exploded view of a transmitter assembly according to an embodiment of the present exemplary system and method.

The towrope transmitter assembly (160) will now be discussed in more detail in connection with FIGS. 4 and 9. FIG. 9 is an exploded view of the towrope transmitter assembly (160) according to an embodiment of the present exemplary system and method. The towrope transmitter assembly (160) may include a fastening strap (169) for coupling the towrope transmitter assembly (160) to the towrope handle (FIG. 4, 198) of the towrope handle assembly (199). Other coupling means may be used to couple the towrope transmitter assembly (160) to the towrope handle (FIG. 4, 198). For example, the towrope transmitter assembly (160) may be coupled to the towrope handle (FIG. 4, 198) via gluing, welding, riveting, or via a number of screws or a number of bolts and nuts, or other fasteners.

The towrope transmitter assembly (160) further includes a bottom cover (167), a top cover (164), a reel-in button (161), a reel-out button (163), and transmitter electronics (165). The bottom cover (167) and top cover (164) are configured to form a housing of which the interior thereof is hermetically sealed. In this manner, water and foreign contaminants such as dirt and silt cannot enter the interior space formed by the bottom cover (167) and top cover (164). Thus, the transmitter electronics (165), which is disposed within the space formed by the bottom cover (167) and top cover (164), will be protected from water and foreign contaminants. Further, the bottom cover (167) and top cover (164) also engage with the reel-in button (161) and reel-out button (163) such that water and foreign contaminants cannot enter the space formed by the bottom cover (167) and top cover (164) via the reel-in button (161) and/or reel-out button (163). Finally, since other buttons and other features may be incorporated into the towrope transmitter assembly (160), these other buttons and other features may also engage with the bottom cover (167) and top cover (164) to ensure that water and foreign contaminants cannot enter into the space formed by the bottom cover (167) and top cover (164).

The transmitter electronics (165) are configured to transmit and receive communications to and from the towrope winch (FIG. 3, 101) located on the watercraft (FIG. 2, 191). The rider (FIG. 2, 195) may selectively activate the reel-in button (161) and reel-out button (163). These instructions may be transmitted to the towrope winch (FIG. 3, 101) via wired or wireless communication methods. As examples of wireless forms of communication, instructions from the rider (FIG. 2, 195) may be transmitted to the towrope winch (FIG. 3, 101) via a radio frequency (RF) transmitter/receiver, a microwave transmitter/receiver, or an infrared (IR) transmitter/receiver. In another exemplary embodiment, the transmitter electronics (165) may be configured to be voice activated, and transmit instructions from the rider (FIG. 2, 195) upon detection of an audible command.

In another exemplary embodiment, the transmitter assembly (160) may be any means configured to transmit data over a wire-based communication technology. For example, a signal wire may be embedded in the towrope (149) for carrying command signals from the transmitter assembly (160) to the towrope winch (101). As similarly discussed above with regard to the wireless embodiment, communication between the transmitter assembly (160) and the t towrope winch (101) is delivered via the embedded signal wire. In this embodiment, the embedded signal wire may be any wire or other direct communication means including metal wires and optical fibers.

Figure 10:
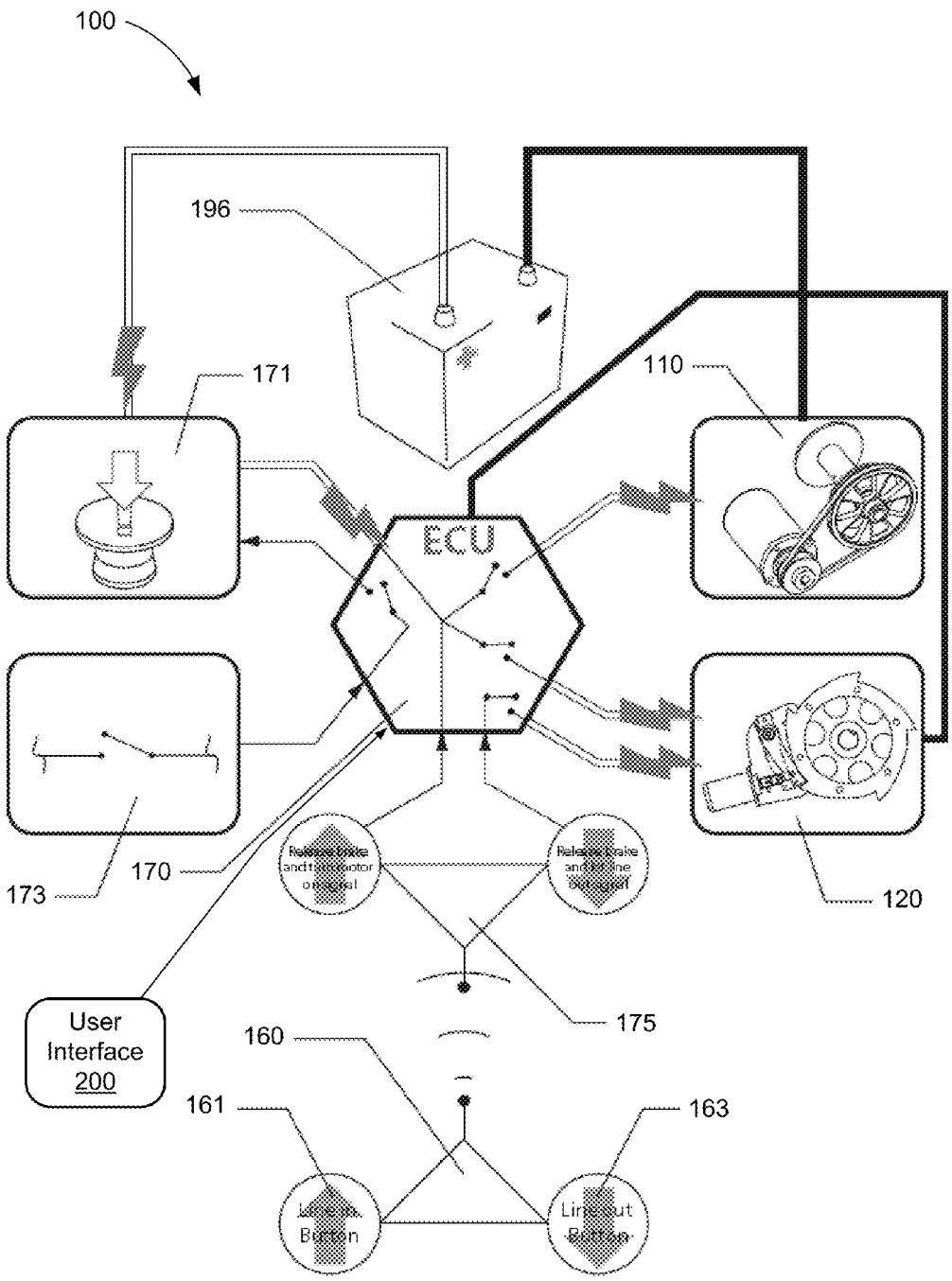
FIG. 10 is a block diagram of the various systems of the tow system of FIG. 4 according to an embodiment of the present exemplary system and method.

The rider (FIG. 2, 195) thus has the ability to control the length of the towrope (149) by activating the reel-in button (161) and reel-out button (163). While being pulled behind the watercraft, the rider (FIG. 2, 195) may selectively push the reel-in button (161), for example, or give a voice command. The transmitter assembly (160) then transmits a command signal to a wireless receiver (FIG. 10, 175). The wireless receiver (FIG. 10, 175) is configured to then relay this information to the ECU (170) which actuates the towrope winch (101). The towrope winch (101) then releases the brake assembly (120), activates the motor (111), and rapidly reels-in a length of the towrope (149) at a rate that allows the rider (FIG. 2, 195) to utilize the added acceleration and speed of the towrope (149) when riding over the wake of the watercraft (FIG. 2, 191).

As further depicted in FIG. 4, the fairlead assembly (150) may comprise several elements including a fairlead bracket (151), a number of vertical rollers (153), and a number of horizontal rollers (157) interposed between the towrope handle assembly (199) and the remainder of the towrope winch (101). The fairlead bracket (151) is configured to house the vertical rollers (153) and horizontal rollers (157). In one exemplary embodiment, two vertical rollers (153) and two horizontal rollers (157) are provided. In this embodiment, the two vertical rollers (153) are positioned on the right and left of the fairlead bracket (151), respectively. Similarly, the two horizontal rollers (157) are position at the top and bottom of the fairlead bracket (151), respectively. Further, the fairlead bracket (151) is configured to secure the fairlead assembly (150) to the towrope winch (101), and, more specifically, the brake chassis (139) and motor chassis (138). In an alternative embodiment, smoothed edges formed on the interior of the fairlead bracket (151) may be used instead of the vertical rollers (153) and horizontal rollers (157).

Figure 5:
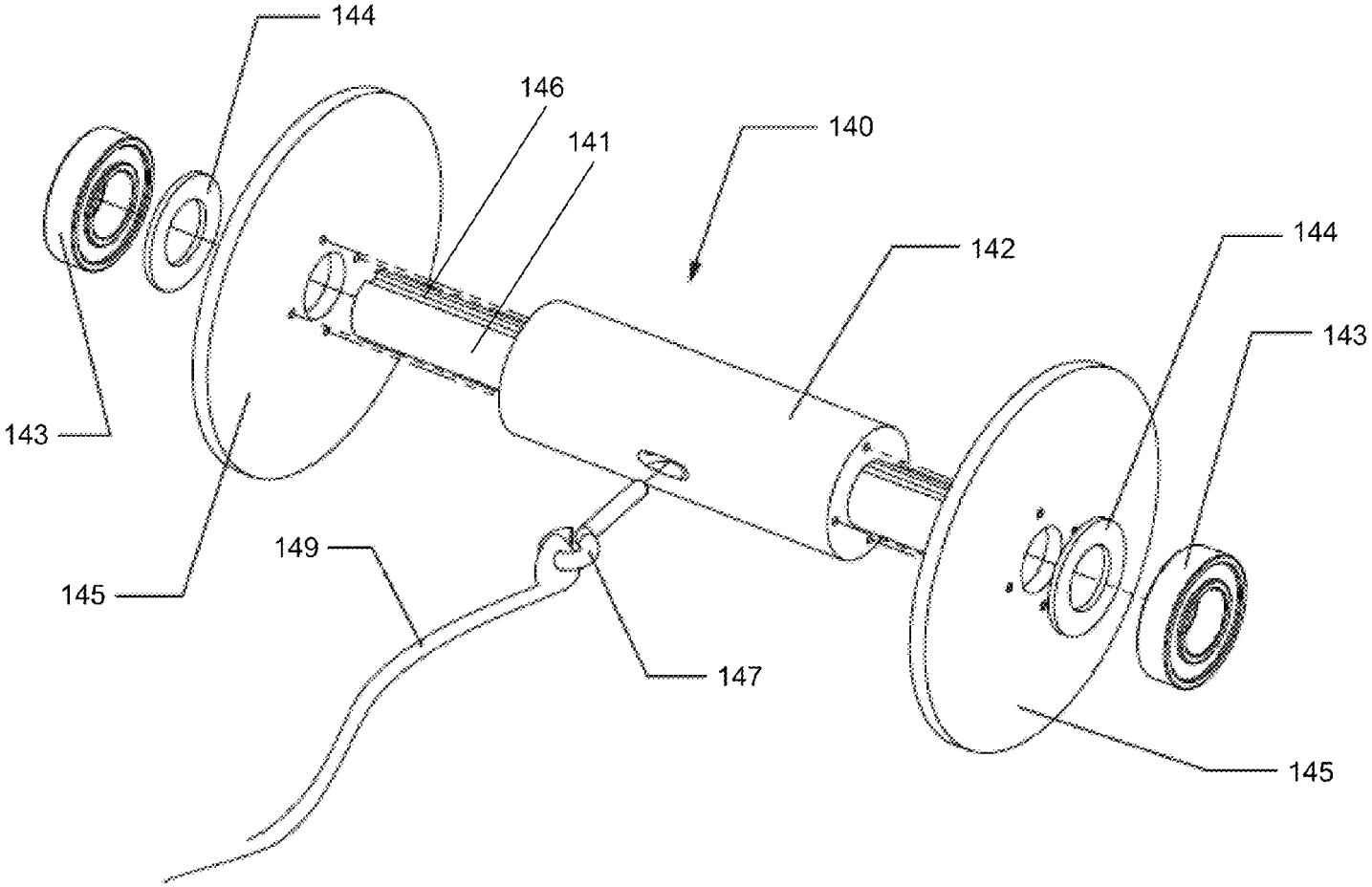
FIG. 5 is an exploded view of the reel assembly of the towrope winch of FIG. 4 according to an embodiment of the present exemplary system and method.

FIG. 4 also depicts a reel assembly (140). The reel assembly (140) will now be described in more detail in connection with both FIG. 4 and FIG. 5. FIG. 5 is an exploded view of the reel assembly of the towrope winch of FIG. 4 according to an embodiment of the present exemplary system and method. The reel assembly (140) may include a reel drive shaft (141), a number of reel bearings (143), a number of reel spacers (FIG. 5, 144), a number of reel flanges (145), a reel drum (142) a towrope eye (147), and a reel guard (134). As depicted in FIG. 4, two of each of the reel bearings (143), reel spacers (FIG. 5, 144), and reel flanges (145) are positioned at respective ends of the reel assembly (140). However, more or less of these elements (143, 144, 145) may be included in the reel assembly (140). The various elements of the reel assembly (140) will now be individually described in more detail.

As depicted in FIGS. 4 and 5, the reel drive shaft (141) is a shaft or rod around which the reel bearings (143), reel spacers (144), reel flanges (145), and reel drum (142) are coupled. The reel drive shaft (141) may be composed of a rigid material such as a metal. A drive shaft recess (146) may be defined along at least a portion of the longitudinal axis of the reel drive shaft (141). Thus, the reel bearings (143), reel spacers (144), reel flanges (145), and reel drum (142) are coupled to the reel drive shaft (141) by mating with the drive shaft recess (146).

In one exemplary embodiment, the reel bearings (143), reel spacers (144), reel flanges (145), and reel drum (142) are coupled to the reel drive shaft (141) by a number of set screws. In this embodiment, set screw bores are defined in each of the reel bearings (143), reel spacers (144), reel flanges (145), and reel drum (142), and the set screws engaged in each set screw bore of each element (143, 144, 145, 142). In this manner, the set screws engage with the set screw bores and the drive shaft recess (146) defined in the reel drive shaft (141). Thus, the reel bearings (143), reel spacers (144), reel flanges (145), and reel drum (142) do not move relative to the reel drive shaft (141).

In yet another exemplary embodiment, a groove similar to the drive shaft recess (146) of the reel drive shaft (141) may be defined in each of the reel bearings (143), reel spacers (144), reel flanges (145), and reel drum (142). In this embodiment, a key pin (FIG. 8, 130) may be disposed within the void formed by the grooves formed in the various elements (143, 144, 145, 142) and the drive shaft recess (146). However, the present system may employ any means that secures the reel bearings (143), reel spacers (144), reel flanges (145), and/or reel drum (142) to the reel drive shaft (141) in order to prevent these elements from moving relative to the drive shaft (141).

FIGS. 4 and 5 also depict reel bearings (143). The reel bearings (143) are configured to provide support for the reel drive shaft (141). In one exemplary embodiment, two sets of reel bearings (143) may be provided that are configured to engage with the motor chassis (FIGS. 4, 138) and brake chassis (FIGS. 4, 139) on respective ends of the reel drive shaft (141). In this manner, the reel drive shaft (141) is free to rotate within the reel bearings (143) while being guided and supported within the motor chassis (FIGS. 4, 138) and brake chassis (FIGS. 4, 139).

Further, as depicted in FIGS. 4 and 5, a number of reel spacers (144) may be position around the reel drive shaft (141), and between the reel bearings (143) and reel flanges (145). In one exemplary embodiment, two reel spacers (144) may be provided; one on each end of the reel assembly (140). The reel spacers (144) provide for an amount of space between the reel flange (145) and motor chassis (FIGS. 4, 138) and brake chassis (FIGS. 4, 139) such that the reel flanges (145) do not rub or wear against either the motor chassis (FIGS. 4, 138) or brake chassis (FIGS. 4, 139).

FIGS. 4 and 5 also depict a number of reel flanges (145). In one embodiment, two reel flanges (145) may be provided around the reel drive shaft (141), and between the reel spacers (144) and the reel drum (142) at respective ends of the reel assembly (140). The reel flanges (145) may be made of any resilient material such as metal, and are configured to retain the towrope (149) on the reel drum (142) so that no portion of the towrope (149) is allowed to wrap around any other portion of the reel assembly (140) except the reel drum (142). For example, the reel flanges (145) are configured to prevent any portion of the towrope (149) from wrapping around the reel spacers (144) and/or reel bearings (143).

Still further, FIGS. 4 and 5 depict the reel drum (142). The reel drum may be made of any material including metal. The reel drum (142) may be of a general cylindrical shape so that the towrope (149) can evenly wind around the reel drum (142). The reel drum (142) may also include a towrope eye (147). The towrope eye (147) may be permanently or removably coupled to the reel drum (142). As depicted in FIGS. 4 and 5, the towrope (149) may be coupled to the towrope eye (147). This may be accomplished by any method including, but not exhaustive of, tying the end of the towrope (149) to the towrope eye (147), or fusing the end of the towrope (149) after it has been threaded through the towrope eye (147). Once the towrope (149) has been attached to the reel drum (142) via the towrope eye (147), the towrope (149) may be wound onto the reel drum (142) by activating the reel assembly (140). In one exemplary embodiment, a line guide (not shown) may also be provided to ensure that any length of the towrope (149) does not bunch on one portion of the reel drum (142).

Finally, as depicted in FIG. 4, the reel assembly (140) may include a reel guard (134). The reel guard (134) may be made of any resilient material such as a metal, and functions to assist the fairlead assembly (150) in guiding the towrope (149) onto the reel drum (142) as the reel assembly (140) begins to reel-in the towrope (149). The reel guard (134) is positioned behind the fairlead assembly (150) and extends around the reel assembly (140). Therefore, the reel guard (134) provides a barrier between moving parts such as the reel assembly (140) and other objects. In this manner, the reel guard (134) helps to reduce or eliminate the risk of a user being injured by moving parts or entangling objects like hair or clothing in the towrope winch (101). As depicted in FIG. 4, the motor chassis (138) and brake chassis (139) may include a recess configured to engage with the reel guard (134) such that the reel guard (134) is maintained in position relative to the motor chassis (138) and brake chassis (139) as well as the reel assembly (140) and fairlead assembly (150).

Figure 6:
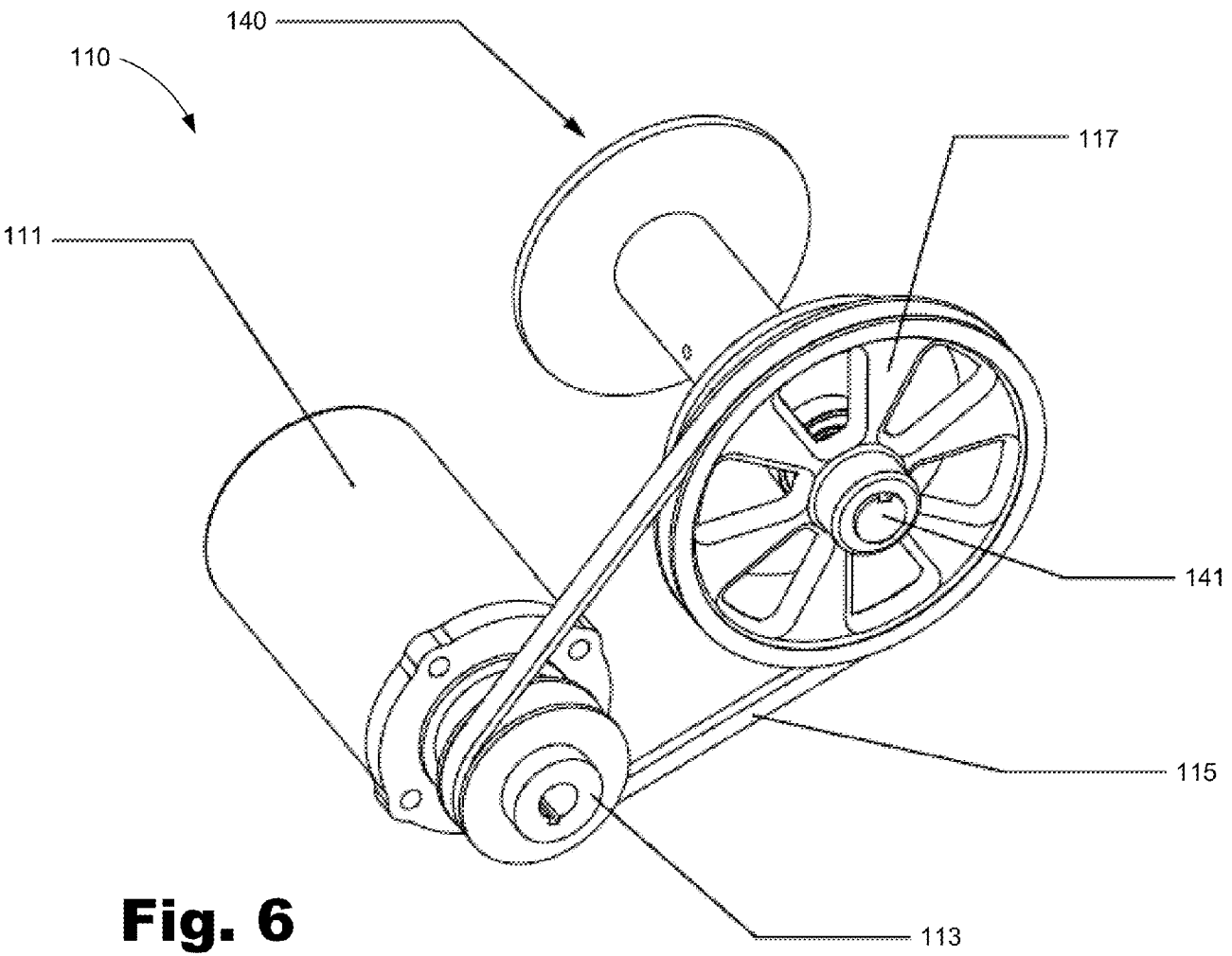
FIG. 6 is a perspective view of a power train including a motor coupled to the reel assembly of the tow system of FIG. 4 according to an embodiment of the present exemplary system and method.

The tow system (100) further includes a power train (110) as depicted in FIGS. 4 and 6. FIG. 6 is a perspective view of the power train (110) including the motor (111) coupled to the reel assembly (140) of the tow system (100) of FIG. 4 according to an embodiment of the present exemplary system and method. Specifically, the power train (110) includes the motor (111), a motor pulley (113), a belt (115), and a reel pulley (117).

The motor (111) may be any device that receives and modifies energy from some source and utilizes it in driving machinery. For example, the motor (111) may be an electric motor, a pneumatic motor, a hydraulic motor, or an internal combustion engine. In one exemplary embodiment, the motor (111) may be an electric motor configured to draw electrical energy from the engine and/or battery of the watercraft (FIG. 2, 191) and/or from an auxiliary power source such as a second battery. In one exemplary embodiment, the motor (111) may be coupled to a heat sink as will be discussed in more detail below.

In one exemplary embodiment, the radial velocity of the motor (111) is variable. Providing variable radial velocity makes it possible to output different towrope (149) reel-in and reel-out speeds and rates of acceleration. With different towrope (149) reel-in and reel-out speeds and rates of acceleration, individual riders (FIG. 2, 195) can use the tow system (100) at a number of specific speeds that are comfortable and provide the desired acceleration. For example, more experienced riders may want a faster towrope (149) reel-in and reel-out speed and rate of acceleration than less experienced beginner or intermediate riders.

In another exemplary embodiment, the motor (111) may be configured to pulse or otherwise slow the towrope (149) as it is reeled in, reeled out, or both. For example, as the towrope (149) is being reeled out, the motor (111) may pulse to slow the reeling out of the towrope (149). Similarly, the motor may be configured to pulse in order to slow the reeling in of the towrope (149). In this manner, the motor (111) acts as a brake apart from the brake assembly (120), and braking of the reel assembly (140) in both rotational directions may be controlled entirely by the motor (111).

More generally, the motor (111) is configured to drive the reel assembly (140) in a reel-in direction, a reel-out direction, or both. The motor (111) may be operatively connected to the reel assembly (140) via a belt and pulley system comprising the motor pulley (113), the belt (115), and the reel pulley (117). The motor pulley (113) is coupled to a drive shaft of the motor (111) such that it does not move relative to the drive shaft of the motor (111). Similarly, the reel pulley (117) is coupled to the reel assembly (140) such that it does not move relative to the reel drive shaft (141) of the reel assembly (140). This may be accomplished in the same manner as discussed above in connection with the various elements of the reel assembly (140).

Specifically, in one exemplary embodiment, the motor pulley (113) and reel pulley (117) may be coupled to the motor (111) and reel drive shaft (141), respectively, by a number of set screws. In this embodiment, set screw bores are defined in each of the motor pulley (113) and reel pulley (117). In this manner, the set screws engage with the set screw bores and a drive shaft recess defined in the drive shaft of the motor, and the drive shaft recess (146) defined in the reel drive shaft (141). Thus, the motor pulley (113) and reel pulley (117) do not move relative to the drive shaft of the motor and the reel drive shaft (141), respectively.

In yet another exemplary embodiment, a groove similar to the drive shaft recess (146) of the reel drive shaft (141) may be defined in each of the motor pulley (113) and reel pulley (117). In this embodiment, a motor drive shaft key pin and the key pin (FIG. 8, 130) may be disposed within the void formed by the grooves formed in the motor pulley (113) and reel pulley (117), and in the drive shaft recess defined in the drive shaft of the motor and the drive shaft recess (146), respectively. However, the present system may employ any means that secures the motor pulley (113) and/or reel pulley (117) to the drive shaft of the motor and reel drive shaft (141) in order to prevent these elements from moving relative thereto. Therefore, as depicted in FIGS. 4 and 6, the motor (111) provides rotational force to the motor pulley (113), which, in turn, rotates the reel pulley (117) and reel assembly (140) via the belt (115). In another exemplary embodiment, the power train may include a number of cogs and a chain. In this embodiment, a cog is provided instead of the motor pulley (113) and another cog is provided instead of the reel pulley (117). The chain may then be placed around the cogs such that the chain engages with the cogs. In this manner, the cogs and chain provide the means by which the rotational force provided by the motor (111) is translated to the reel assembly (140).

Still further, in another exemplary embodiment, the motor (111) may be coupled to a series of gears (not shown). Different gear ratios that will change the radial velocity and torque of the motor's (111) output into a specific radial velocity and torque that can be utilized in different circumstances. In one example, the gears may provide a gear ratio that produces a radial velocity of 500 to 1000 or more revolutions per minute (RPM's). This radial velocity makes it possible for the rider (195) to experience an increase in acceleration through the tow system (100). In one exemplary embodiment, the gears may be adjustable such that a rider (195) can vary the speed and acceleration at which the towrope (149) is wound by the towrope winch (101).

The towrope winch (FIG. 3, 101) may also include a heat sink (137). The heat sink (137) is placed juxtaposition to the motor (111) and/or ECU (170). In one exemplary embodiment discussed above, a heat sink is placed between the reel assembly (140) and the motor (111). In another exemplary embodiment, the heat sink (137) may be positioned next to or coupled to the ECU (170). The heat sink (137) is configured to absorb and dissipate heat away from the ECU (170) and/or motor (111) such that the ECU (170) and motor (111) are not subjected to temperatures that may damage the ECU (170) or motor (111) or cause the ECU (170) or motor (111) to prematurely wear or not perform as intended.

Figure 7:
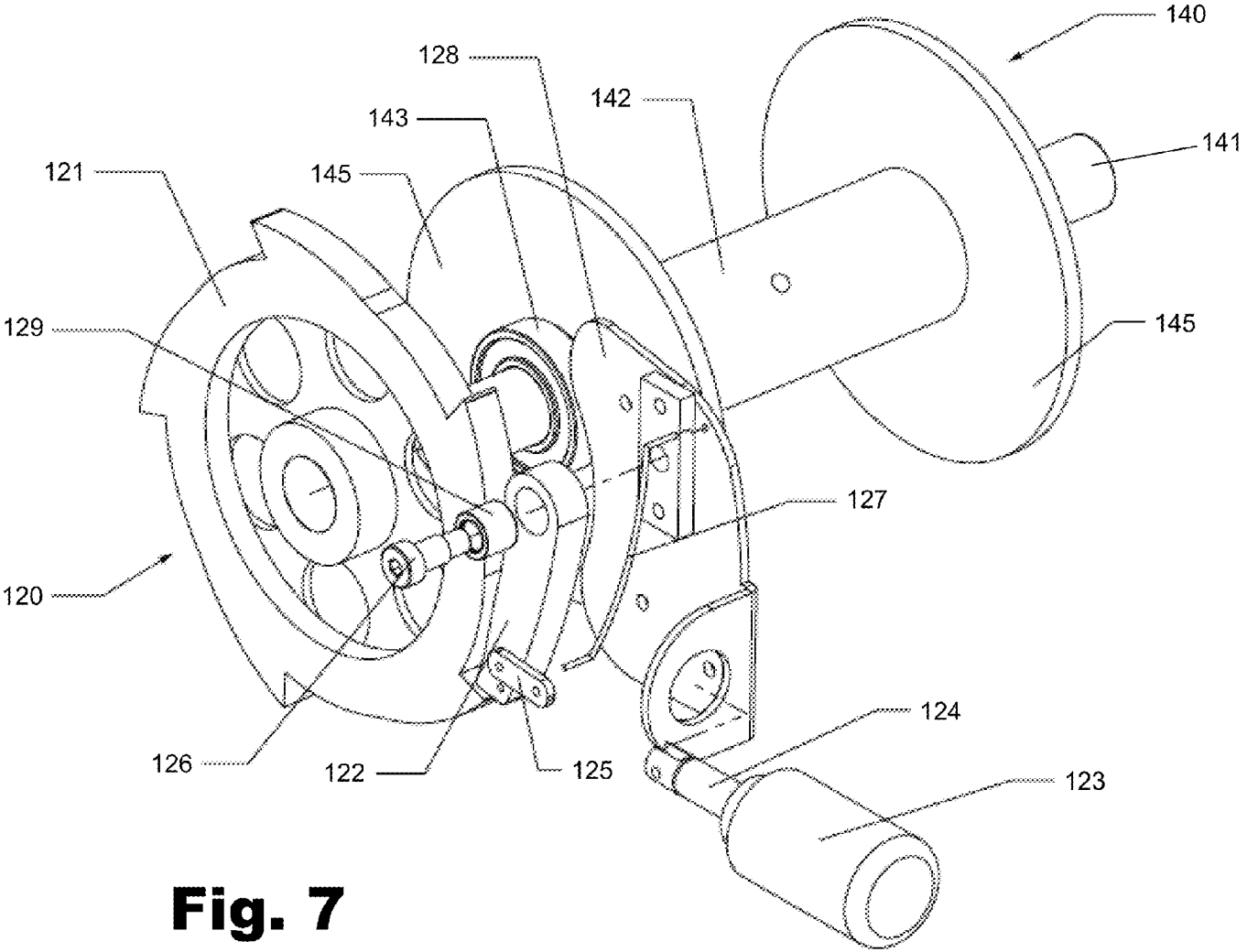
FIG. 7 is a perspective view of a brake assembly coupled to the reel assembly of the tow system of FIG. 4 according to an embodiment of the present exemplary system and method.
Figure 8:
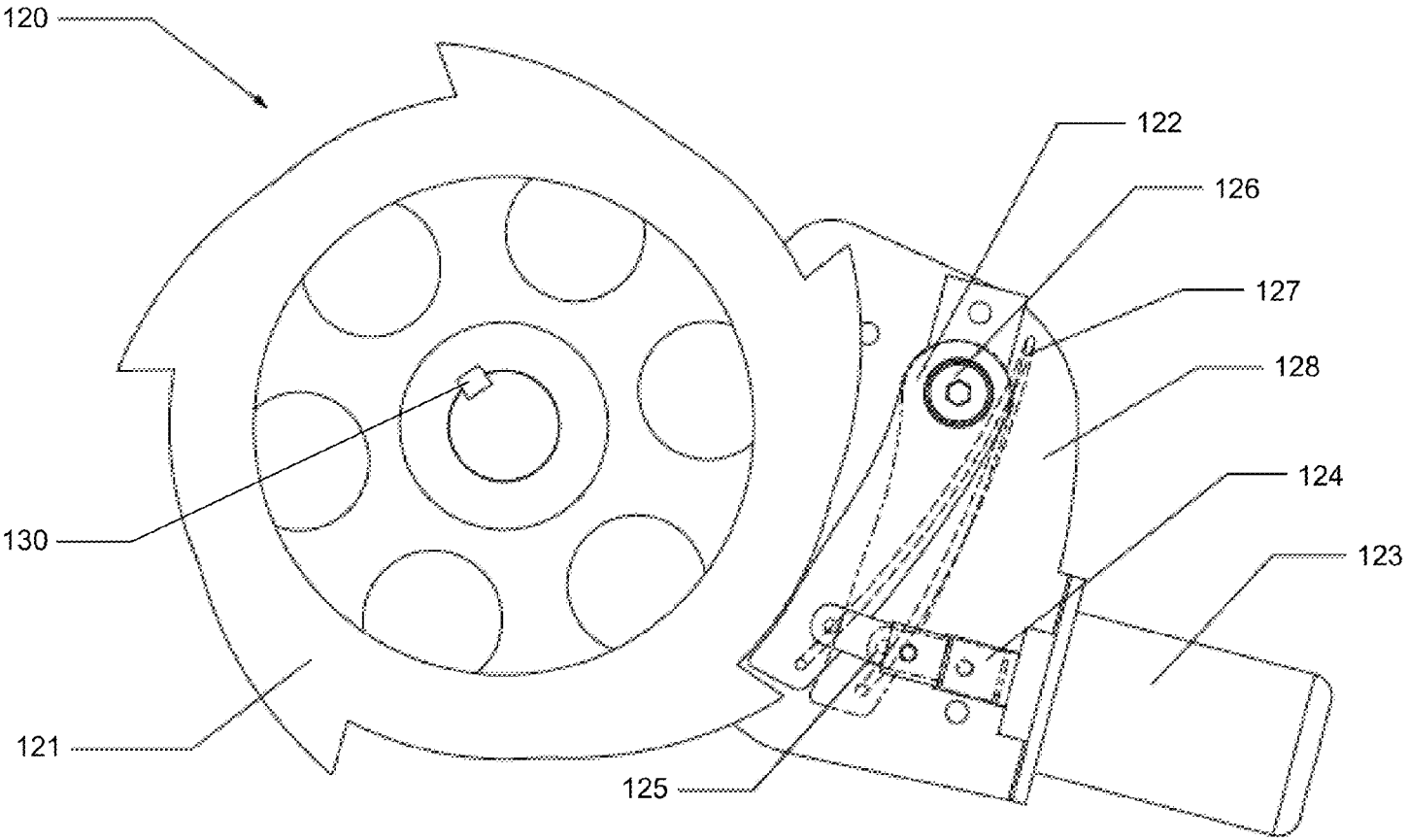
FIG. 8 is a side view of the brake assembly of FIGS. 4 and 7 showing the actuation of the brake assembly according to an embodiment of the present exemplary system and method.

The brake assembly (120) will now be described in more detail in connection with FIGS. 4, 7, and 8. FIG. 7 is an exploded view of the brake assembly (120) coupled to the reel assembly (140) of the tow system (100) of FIG. 4 according to an embodiment of the present exemplary system and method. FIG. 8 is a side view of the brake assembly of FIGS. 4 and 7 showing the actuation of the brake assembly (120) according to an embodiment of the present exemplary system and method. Generally, the brake assembly (120) may include a ratchet wheel (121), a pawl (122), a pawl pivot bolt (126), a pawl bearing (129), a pawl spring (127), a pawl support plate (128), a pawl linkage (125), a solenoid body (123), and a solenoid plunger (124). This embodiment provides for a more quite braking system that is also less expensive than other braking systems.

In general, the brake assembly (120) may include any ratcheting device that allows continuous rotary motion of the ratchet wheel (121) in only one direction while selectively preventing motion in the opposite direction. The ratchet wheel (121) may have any number of teeth configured to engage with the pawl (122). In one exemplary embodiment, the ratchet wheel (121) may have between 5 and 10 teeth. In FIGS. 4, 7, and 8, the ratchet wheel (121) is free to move in the clockwise direction as viewed from the perspective of FIG. 8, but prevented from rotating in the counter clockwise direction by the engagement of the pawl (122). Further, when the pawl (122) is not engaged, the ratchet wheel (121) is free to move in either the clockwise or counter clockwise directions.

The ratchet wheel (121) is mounted on the reel assembly (140), and, in particular, the reel drive shaft (141). The reel bearing (143) engages with the brake chassis (139) as discussed above, and the ratchet wheel (121) is coupled to the reel drive shaft (141) through the brake chassis (139). Thus, the brake chassis (139) is positioned between the reel assembly (140) and ratchet wheel (121). As similarly discussed above, the ratchet wheel (121) may be coupled to the reel drive shaft (141) by a number of set screws. In this embodiment, a number of set screw bores are defined in the ratchet wheel (121), and the set screws engaged in each set screw bore of the ratchet wheel (121). In this manner, the set screws engage with the set screw bores and the drive shaft recess (FIG. 5, 146) defined in the reel drive shaft (141). Thus, the ratchet wheel (121) does not move relative to the reel drive shaft (141).

In yet another exemplary embodiment, a groove similar to the drive shaft recess (FIG. 5, 146) of the reel drive shaft (141) may be defined in the ratchet wheel (121). In this embodiment, a key pin (FIG. 8, 130) may be disposed within the void formed by the groove formed in the ratchet wheel (121) and the drive shaft recess (FIG. 5, 146). However, the present system may employ any means that secures the ratchet wheel (121) to the reel drive shaft (141) in order to prevent the ratchet wheel (121) from moving relative to the drive shaft (141).

The pawl (122) is coupled to the brake chassis (139) via a pawl support plate (128). The pawl support plate (128) is coupled to the brake chassis (139) via gluing, welding, riveting, or via a number of screws or a number of bolts and nuts, or other fasteners. However, the pawl support plate (128) may be coupled to the brake chassis (139) by any means that sufficiently secures the pawl support plate (128) to the brake chassis (139).

As depicted in FIGS. 4, 7, and 8, the pawl (122) has a pivoting end about which it pivots, and also includes a distal end that is configured to engage with the ratchet wheel (121). The pawl (122) is coupled to the pawl support plate (128) via the pawl pivot bolt (126) and pawl bearing (129). The pawl pivot bolt (126) may be any bolt that is configured to secure the pawl (122) to the pawl support plate (128). In one exemplary embodiment, and as depicted in FIGS. 4, 7, and 8, pawl pivot bolt (126) is configured to be countersunk within the pawl (122). A pawl bearing (129) may also be provided. The pawl bearing (129) is position around the pawl pivot bolt (126), and countersunk within the pawl (122) with the pawl pivot bolt (126). In this manner, the pawl bearing (129) allows unrestrictive movement of the pawl (122) about the pawl pivot bolt (126).

As depicted in FIGS. 4, 7, and 8, the brake assembly (120) may also include a pawl spring (127). In one exemplary embodiment, the pawl spring (127) is biased to pull the pawl (122) to the left, as depicted in FIG. 8, and engage the pawl (122) in the teeth of the ratchet wheel (121). Thus, in this embodiment, the pawl spring (127) is configured to automatically engage the brake assembly (120) when no force is applied to the pawl (122) in the right or non-engagement direction. In another embodiment, the pawl spring (127) may be biased to the pull the pawl (122) to the right, and remain disengaged with the ratchet wheel (121) until a force is applied in the left or engagement direction.

The pawl spring (127) is coupled to the pawl (122) in a manner such that the pawl spring (127) cannot slip around or move relative to the pawl (122). In one exemplary embodiment, and as depicted in FIGS. 7 and 8, an end of the pawl spring (127) may be configured to enter a hole defined in the distal end of the pawl (122). Thus, the pawl spring (127) is always engaged with the pawl (122). However, the pawl spring (127) may be coupled to the pawl (122) in any manner including, for example, gluing, welding, riveting, or via a number of screws or a number of bolts and nuts, or other fasteners.

The brake assembly (120) further comprises a pawl linkage (125), a solenoid body (123), and a solenoid plunger (124). The solenoid plunger (124) is coupled to the distal end of the pawl (122) via the pawl linkage (125) as depicted in FIGS. 4, 7, and 8. The solenoid body (123) is configured to be selectively activated. When this occurs, the solenoid body (123) moves the solenoid plunger (124) such that the solenoid plunger (124) causes the pawl (122) to disengage with the ratchet wheel (121) via the pawl linkage (125). In other words, the solenoid body (123), upon activation, pulls the solenoid plunger (124) to the right as depicted in FIG. 8, such that the pawl (122) disengages the ratchet wheel (121). Similarly, the solenoid body (123) is further configured to be selectively deactivated, causing the solenoid plunger (124) to move to the left due to the spring force of the pawl spring (127) such that the pawl (122) engages with the ratchet wheel (121). The solenoid body (123) is coupled to the pawl support plate (128) by, for example, gluing, welding, riveting, or via a number of screws or a number of bolts and nuts, or other fasteners.

In addition to the elements described above, the tow system (100) of FIG. 4 may also incorporate a number of fans and ducts throughout the tow system (100) for cooling various devices within the tow system (100). More specifically, the fans and ducts may be configured to run throughout the tow system (100) in a manner so as to cool elements of the tow system (100) that heat up during operation of the tow system (100) such as the ECU (170) and the power train (110).

FIG. 10 is a block diagram of the various systems of the tow system (100) of FIG. 4 according to an embodiment of the present exemplary system and method. The tow system (FIG. 4, 100) may include an electronic control unit (ECU) (170), a power source (196), the power train (110), the brake assembly (120), an emergency shut-off switch (171), a number of safety switches (173), the wireless receiver (175), and the towrope transmitter assembly (160).

As depicted in FIG. 10, the ECU (170) may be any device that controls one or more of the electrical systems or subsystems of the tow system (FIG. 4, 100), and may include a processor, central processing unit, or other controller. The ECU (170) may be embodied in the tow system (FIG. 4, 100), the watercraft (FIG. 2, 191), or may be located away from both the tow system (FIG. 4, 100) and the watercraft (FIG. 2, 191). In one exemplary embodiment, the ECU (170) is contained within the tow system (FIG. 4, 100), and may be electronically coupled to one or more systems within the watercraft (FIG. 2, 191), or other ECU devices of the watercraft (FIG. 2, 191). In this embodiment, the ECU (170) may, for example, be configured to receive instructions from a user via the transmitter assembly (160) or user interface system (FIGS. 11 and 12, 200), and control the watercraft (FIG. 2, 191). For example, the ECU (170), after receiving instructions, may be configured to cause the watercraft (FIG. 2, 191) to increase its speed. Further, the ECU (170) may also be configured to cause the watercraft (FIG. 2, 191) to accelerate at a predefined or user defined rate. In this manner, the rider (FIG. 2, 195) may have more control over the functions of the watercraft (FIG. 2, 191). In another exemplary embodiment, the ECU (170) may be contained within the watercraft (FIG. 2, 191) as either a pre-market or an after-market component.

Further, the ECU (170) may receive instructions from a user of the tow system (FIG. 4, 100). For example, the ECU (170) may receive instructions from a rider (FIG. 2, 195) via the transmitter assembly (160). In addition, the ECU (170) may receive instructions from a user interface system (FIGS. 11 and 12, 200) located within the watercraft (FIG. 2, 191) or at a remote location such as a shore area. The user interface system (200) will be discussed in more detail below.

As depicted in FIG. 10, the ECU (170) is configured to control the power train (110), and, more specifically, the motor (111). The ECU (170) controls the direction at which the motor (111) turns, and, thus, effects the rotational direction of the reel assembly (FIGS. 4 and 5, 140) (coupled to the motor (111) via the motor pulley (113), belt (115), and reel pulley (117)). For example, the ECU (170), upon receiving instructions to reel in the towrope (FIGS. 4 and 5, 149), controls the motor (111) to turn in the direction required for reeling in the towrope (FIGS. 4 and 5, 149). Similarly, the ECU (170), upon receiving instructions to reel out the towrope (FIGS. 4 and 5, 149), controls the motor (111) to turn in the direction required for reeling out the towrope (FIGS. 4 and 5, 149). For example, upon receiving instructions to reel out the towrope (FIGS. 4 and 5, 149), the ECU (170) causes the brake assembly (120) to disengage the pawl (FIGS. 4, 7, and 8, 122) from the ratchet wheel (121), and causes the motor to reel out the towrope (FIGS. 4 and 5, 149).

In one exemplary embodiment, the ECU (170) may be configured to cause the motor (FIGS. 4 and, 111) to pulse during the reeling out of the towrope (FIGS. 4 and 5, 149). In this embodiment, the motor (FIGS. 4 and, 111) slows or otherwise modifies the speed and/or acceleration of the reel out of the towrope (FIGS. 4 and 5, 149). Thus, a rider (FIG. 2, 195) can experience a slower reel out of the towrope (FIGS. 4 and 5, 149) if the rider (FIG. 2, 195) is, for example, less experienced.

The ECU (170) may also be configured to control the brake assembly (120), and, more specifically, the solenoid body (FIGS. 4, 7, and 8, 123). The ECU (170) controls the activation and deactivation of the solenoid body (FIGS. 4, 7, and 8, 123). As described above, this in turn engages the pawl (FIGS. 4, 7, and 8, 122) with the ratchet wheel (FIGS. 4, 7, and 8, 121). Thus, upon receiving instructions to stop the reeling in or reeling out of the towrope (FIGS. 4, and 5, 149), the ECU (170) is configured to actuate the brake assembly (120).

Further, the ECU (170) may be configured to deactivate one or more devices or assemblies of the tow system (100) or watercraft (FIG. 2, 191) upon activation of an emergency shut-off switch (171). Any number of emergency shut-of switches (171) may be located on the tow system (100) and watercraft (FIG. 2, 191). For example, an emergency shut-off switch (171) may be located with the transmitter assembly (160), on the towrope winch (FIG. 3, 101), or on the watercraft (FIG. 2, 191). Upon activation of one or more of the emergency shut-off switches (171), the ECU (170) may deactivate, for example, the motor (FIGS. 4 and 6, 111), and may ensure engagement of the brake assembly (120). In one exemplary embodiment, the tow system (100) will not re-activate until one or more of the emergency shut-of switches (171) are deactivated. In this manner, the emergency shut-of switches (171) provide a safe environment for the rider (FIG. 2, 195) where, in the event of an unforeseen incident, the rider (FIG. 2, 195), operator (FIG. 2, 193), or other person may activate one or more of the emergency shut-of switches (171).

Finally, the ECU (170) may be configured to deactivate one or more devices or assemblies of the tow system (100) or watercraft (FIG. 2, 191) upon activation of a number of safety switches (173) in a similar manner as detailed above in connection with the emergency shut-of switches (171). In one exemplary embodiment, the safety switches (173) may include, for example, switches which are activated in the event that an object like hair, loose clothing or other foreign objects are pulled into the towrope winch (FIG. 3, 101). In another exemplary embodiment, the safety switches (173) may include, for example, switches that are activated in the event that the rider (FIG. 2, 195) no longer is holding onto the towrope (149). In this embodiment, if the angle of the towrope (FIGS. 4 and 5, 149) and/or tension applied to the towrope (FIGS. 4 and 5, 149) changes from the angle and tension that would be expected while the rider is holding onto the towrope (FIGS. 4 and 5, 149), a safety switch (173) may be activated. In yet another exemplary embodiment, the safety switches (173) may include, for example, switches which are activated in the event that the towrope winch (FIG. 3, 101) is improperly coupled to the tower (FIGS. 2, 3, and 4, 131) of the watercraft (FIG. 2, 191).

In yet another exemplary embodiment, the safety switches (173) may include, for example, switches that are activated if the rider (FIG. 2, 195) reels in too much of the length of the towrope (FIGS. 4 and 5, 149) so as to place the rider (FIG. 2, 195) too close to the back end of the watercraft (FIG. 2, 191) such as the swim deck, or from moving parts of the watercraft (191) such as those associated with an inboard, outboard, or inboard/outboard motor.

Thus, if a certain length of towrope (FIGS. 4 and 5, 149) is reeled in, the safety switch (173) of this embodiment may be activated. The length of towrope (FIGS. 4 and 5, 149) that may be reeled in before this safety switch (173) is activated may be predefined, user-defined, or based on a fraction the entire length of the towrope (173). Further, activation of this safety switch (173) may cause the ECU (170) to deactivate the motor (FIGS. 4 and 6, 111), engage the brake assembly (120), or both. Finally, in one exemplary embodiment, one or more of the above-explained safety switches (173) may be deactivated or otherwise rendered inoperable by a user.

Finally, the ECU (170) may be configured to control or interact with a user interface system (200). The user interface system (200) may be any device, system of devices, computer code, or combinations thereof that may be utilized by a user in controlling the input and output of a computing system or other device. The user interface system (200) will now be described in more detail.

Figure 11:
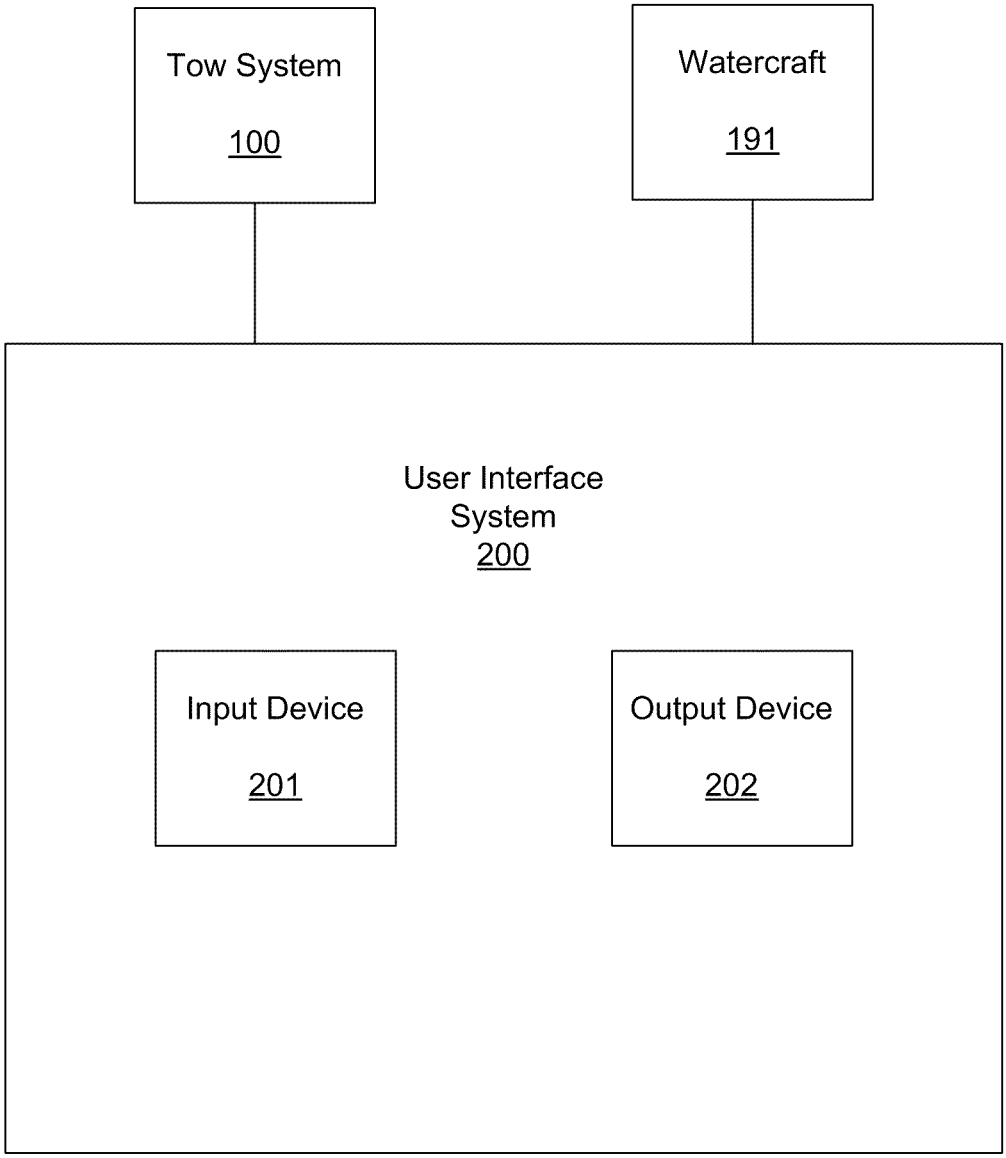
FIG. 11 is a block diagram of the tow system of FIG. 4 incorporating a user interface system according to an embodiment of the present exemplary system and method.

FIG. 11 is a block diagram of the tow system (100) of FIG. 4 incorporating a user interface system (200) according to an embodiment of the present exemplary system and method. The user interface system (200) may include a number of input devices (201) such as, for example, a keyboard, a mouse, and/or a touch screen display for imputing information to an information processing system. Further, the user interface system (200) may also include a number of output devices (202) such as, for example, a display device and/or touch screen display in order to communicate the results of data processing carried out by an information processing system to a user.

In the exemplary embodiment of FIG. 11, the information processing system may include or be embodied in the tow system (100) and/or the watercraft (FIG. 2, 191). In this exemplary embodiment, the ECU (FIG. 10, 170) of the tow system (100) is configured to receive instructions from the user via the user interface system (200), and perform such instructions. Further, in this embodiment, the watercraft may be configured to also receive instructions from a user via the user interface system (200), and perform such instructions. As depicted in FIG. 11, these instructions are relayed to the tow system (100) and watercraft (191) via the input devices (201), and information regarding the operation of the tow system (100) and watercraft (191) are displayed on one or more of the output devices (202).

Figure 12:
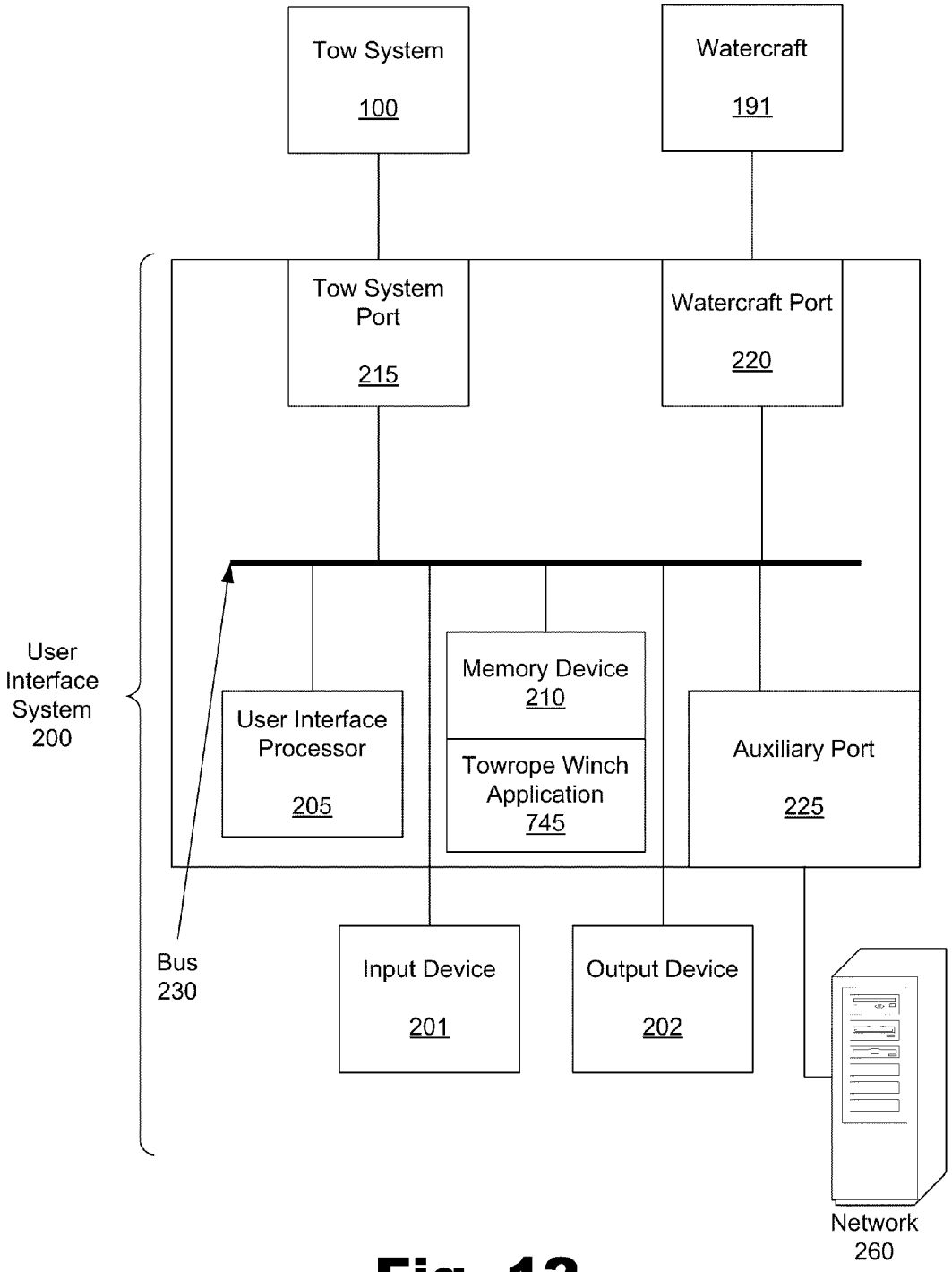
FIG. 12 is a block diagram of the tow system of FIG. 4 incorporating a user interface system according to another embodiment of the present exemplary system and method.

FIG. 12 is a block diagram of the tow system of FIG. 4 incorporating a user interface system according to another embodiment of the present exemplary system and method. In this exemplary embodiment, the user interface system (200) is configured to receive data or instructions via a number of the input devices (201), processes the data and instructions via a user interface processor (205), and output the results to a user via a number of the output devices (202). In this embodiment, the user interface system (200) is also configured to control a number of operating parameters of the tow system (100) and watercraft (FIG. 2, 191).

More specifically, the user interface system (200) of FIG. 12 includes a number of input devices (201) and a number of output devices (202) as described above in connection with FIG. 11. Further, the user interface system (200) includes a processor (205), a number of memory devices (210), a tow system port (215), a watercraft port (220), a number of auxiliary ports (225), and a bus (230). Each of these devices will now be explained in more detail.

The processor (205) may include any central processing unit that carries out the instructions of a computer program stored on, for example, the memory devices (210) or stored external to the user interface system (200). The processor (205) may be any processor used in connection with a general purpose computer, a special purpose computer, or other programmable data processing apparatus, such that the instructions, which execute via the processor (205) of the user interface system (200), implement the instructions inputted to the user interface system (200) from the input devices (201), the tow system (100), and/or the watercraft (191).

The bus (FIGS. 12 and 13, 230) is any subsystem that transfers data between user interface system (200) components inside the user interface system (200) or between devices such as the user interface system (200), the tow system (100), the watercraft (191), and/or a network (260). The network (260) may include any system of computing devices, computer terminals, audio or visual display devices, or mobile devices such as telephones interconnected by a telecommunication system (wireless communication devices) or cables (wired communication), and used to transmit and receive data. As will be discussed in more detail below, the network (260) may also include connectivity to the Internet or an intranet.

The memory devices (210) of the user interface system (200) are configured to store data in connection with the operation of the tow system (100) and watercraft (191) as well as any computer programs used in association with the control of the tow system (100) and watercraft (191) including an operating system. The memory devices (210) also store any computer programs required to control the various devices of the user interface system (200) including the input devices (201), the output devices (202), the tow system port (215), the watercraft port (220), and the auxiliary port (225). The memory devices (210) may include any computer usable or computer readable medium. For example, the memory devices may be, but are not limited to, an electronic, magnetic, optical, electromagnetic, infrared, or semiconductor system, apparatus, device, or propagation medium. More specific examples of the memory devices may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device.

The tow system port (215), watercraft port (220), and auxiliary port (225) may be any interface between the user interface system (200) and other computers or peripheral devices such as the tow system (100), the watercraft (191), or servers supporting the Internet or an intranet. The tow system port (215), watercraft port (220), and auxiliary port (225) may be any parallel or serial port, and may further be configured as plug-and-play ports. More specifically, the tow system port (215), watercraft port (220), and auxiliary port (225) may be USB ports, firewire ports, ethernet ports, PS/2 connector ports, video graphics array (VGA) ports, or small computer system interface (SCSI) ports. The tow system port (215) is configured to provide signal transfer between the user interface system (200) and the tow system (100). Similarly, the watercraft port (220) is configured to provide signal transfer between the user interface system (200) and the watercraft (191). Finally, the auxiliary port (225) is configured to provide signal transfer between the user interface system (200) and other computing devices or servers supporting the Internet or an intranet such as the network (260), and any other device such as external memory devices.

As stated above in connection with FIGS. 11 and 12, the user interface system (200) may include one or more output devices (202) such as a display device. The tow system (100) outputs information to the output devices (202) regarding current working parameters of the tow system (100) including the activation of one or more safety switches (FIG. 10, 173), the activation of the emergency shut-off switches (FIG. 10, 171), the current working state of the power source (FIG. 10, 196), power train (FIG. 10, 110), and brake assembly (FIG. 10, 120), the transmission of commands from the transmitter assembly (FIG. 10, 160) to the wireless receiver (FIG. 10, 175), the current working state of the ECU (FIG. 10, 170), the amount of towrope (FIG. 4, 149) reeled out, the speed and acceleration of towrope (FIG. 4, 149) reel-in or reel-out, and the name and profile of the rider (FIG. 2, 195), among others. In addition to this information, other parameters may be displayed on the output devices (202) including working parameters of the watercraft (FIG. 2, 191) or any system or subsystem thereof. For example, the output devices (202) may be configured to display information regarding the current speed of the watercraft (FIG. 2, 191), the RPM's of the watercraft's (FIG. 2, 191) motor, and/or the type of watercraft (FIG. 2, 191) to which the tow system (100) is coupled.

Similarly, as stated above in connection with FIGS. 11 and 12, the user interface system (200) may include a number of input devices (201). The input devices may be provided to a user for inputting commands to the tow system (100) and/or watercraft (191). For example, the input devices (201) may be used to instruct the tow system (100) to reel in or reel out the towrope (FIGS. 4 and 5, 149). In this manner, the operator (FIG. 2, 193) of the watercraft (191) or any other person such as a ski instructor may control the tow system (100) for the benefit of, for example, teaching the rider (FIG. 2, 195).

Figure 13:
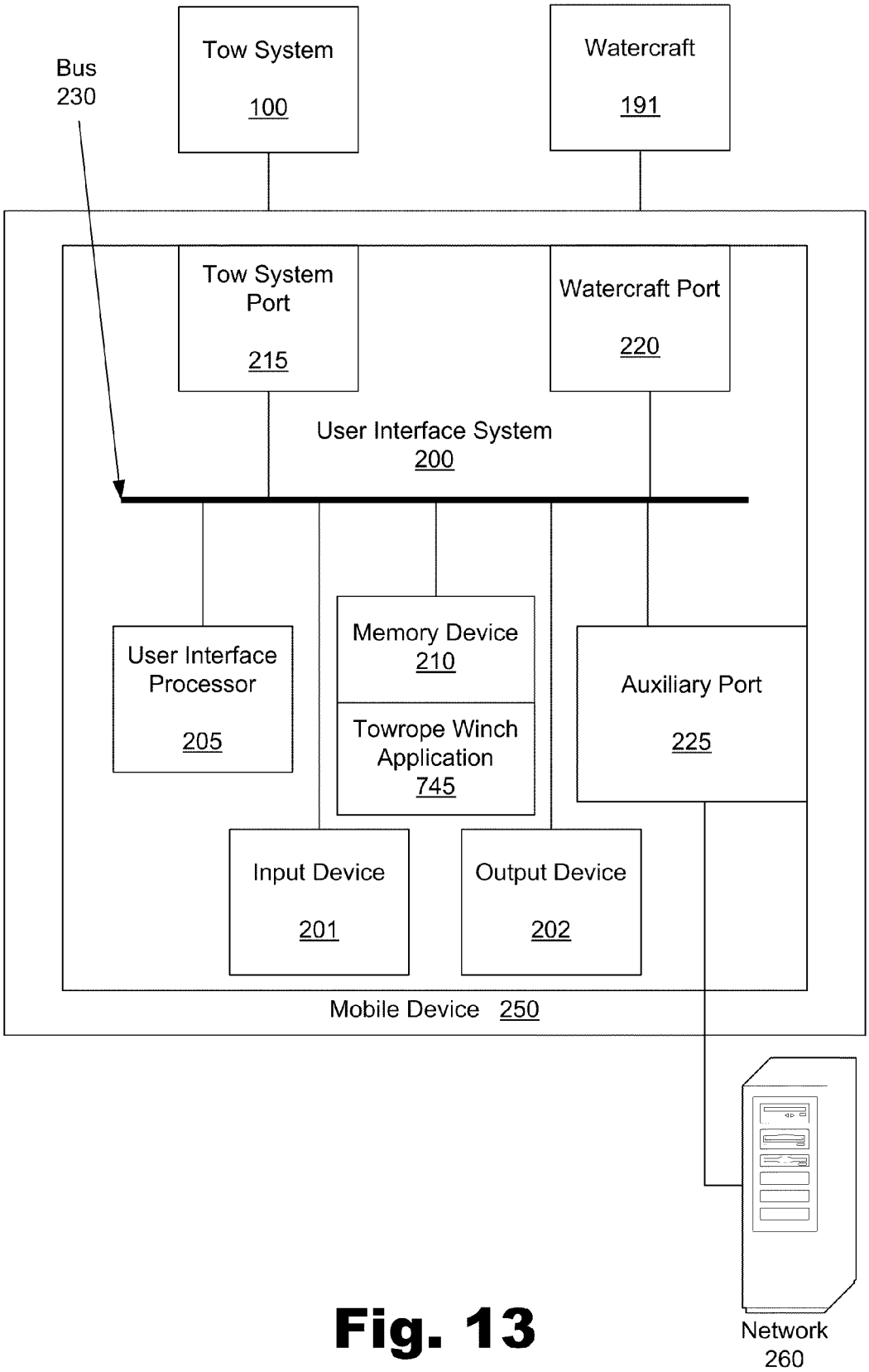
FIG. 13 is a block diagram of the tow system of FIG. 4 incorporating a user interface system according to another embodiment of the present exemplary system and method.

In connection with FIG. 13, the user interface system (200) may be embodied in a mobile device (250) such as a touch screen display device, a mobile telecommunications device, a personal digital assistant (PDA), a handheld computer, a laptop computer, a desktop computer, or a web-based user interface. More specifically, the user interface system (200) may be embodied in a device such as a touch screen mobile telecommunications device that is Internet and/or multimedia enabled or otherwise connected to a network. Some examples of such as devices may be an iPhone® developed by Apple, Inc.™, the BlackBerry® Storm® developed by Research In Motion™ or other smart phones. In this embodiment, any necessary computer code required to operate the user interface (200) in connection with the tow system (100) and watercraft (191) may be embodied within the memory devices (210) at the point of sale of the user interface system (200), or may be downloaded to the user interface system (200) via the network (260). For example, in one exemplary embodiment, a user may download the computer code configured to provide electronic communication between the user interface system (200), the tow system (100), and the watercraft (191) via the network (260).

In the embodiment of FIGS. 12 and 13, the user interface may further be configured to connect to a number of web pages via the network (260). Thus, in this embodiment, a user may access a web page that allows for the creation, updating, and printing of rider (FIG. 2, 195) profiles and statistics. For example, the web page may allow for the creation, updating, and printing of a new rider profile that includes, for example, the rider's (FIG. 2, 195) name, age, sex, or water skiing ability (e.g. levels of skill such as expert, intermediate, or novice), among others. Further, the web page may allow for the creation, updating, and printing of a boat profile. For example, the boat profile may include the various specifics of the watercraft (191) such as the type and size of the watercraft (191), the type and size of the watercraft's (191) engine, whether the watercraft's (191) engine is an inboard, an outboard, or an inboard/outboard engine, the watercraft's (191) engine performance, and the distance from the watercraft's (191) tower (FIGS. 2, 3, and 4, 131) to the stern or back deck of the watercraft (191), among others. Thus, a web page may be utilized by the user interface system (200) to provide information and instructions to the user interface system (200) regarding the operation of the tow system (100) and watercraft (191).

Figure 14:
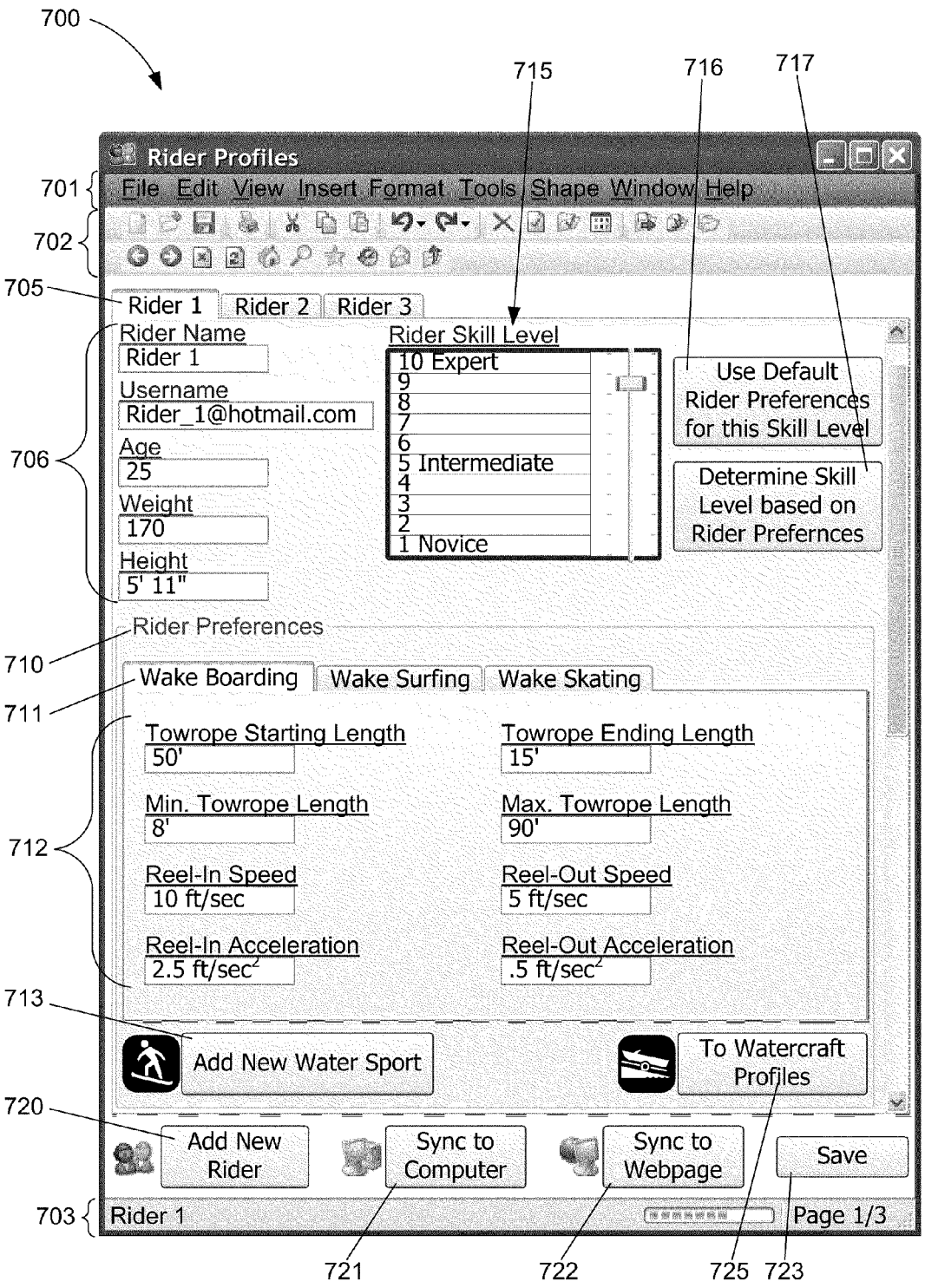
FIG. 14 is a diagram of a rider profile page of a towrope winch application according to an embodiment of the present exemplary system and method.

FIG. 14 is a diagram of a rider profile page (700) of a towrope winch application (FIGS. 12 and 13, 745) according to an embodiment of the present exemplary system and method. In one exemplary embodiment, the information displayed in FIG. 14 may be displayed on the output device (FIGS. 11, 12, and 13, 202) of the user interface system (FIGS. 11, 12, and 13, 200). Thus, in thus embodiment, a computer program such as the towrope winch application (FIGS. 12 and 13, 745) may be present on or downloaded to the memory devices (FIGS. 12 and 13, 210) of the user interface system (FIGS. 11, 12, and 13, 200). However, the towrope winch application (FIGS. 12 and 13, 745) may be present on or downloaded to other computing devices or servers supporting the Internet or an intranet such as the network (FIGS. 12 and 13, 260), and any other device such as external memory devices.

In one exemplary embodiment, the rider profile page (700) may be embodied as a number of windows of a program such as a towrope winch application (FIGS. 12 and 13, 745) configured to run in connection with the tow system (FIG. 4, 100), a number of watercraft (FIG. 2, 191), a number of computing devices, and/or the user interface system (FIGS. 11, 12, and 13, 200). In another embodiment, the rider profile page (700) may be embodied as a number of web pages configured to be downloaded from the Internet or an intranet, and configured to run in connection with the tow system (FIG. 4, 100), a number of watercraft (FIG. 2, 191), a number of computing devices, and/or the user interface system (FIGS. 11, 12, and 13, 200). Finally, the rider profile page (700) may include any number of buttons, icons, menus, or other input or output elements for carrying out the various functions of the towrope winch application (FIGS. 12 and 13, 745).

Specifically, as depicted in FIG. 14, the rider profile page (700) may include a menu bar (701), a toolbar (702), and a status bar (703). The menu bar (701) may include any window or application specific menus that provide access to such functions as opening files, interacting with an application, or help resources. The toolbar (702) may include any number of buttons, icons, or other input or output elements for carrying out the various functions of the towrope winch application (FIGS. 12 and 13, 745). Finally, the status bar (703) may be configured to display any information about the current state of the current window including tabs currently being viewed, progress of a task, such as a download or file transfer, and a page currently being viewed, among others.

FIG. 14 further depicts rider profile tabs (705) and rider information (706). The rider profile tabs (705) are configured to allow a user to switch between different riders' profiles. As depicted in FIG. 14, the Rider 1 tab is selected. Thus, Rider 1's information and other settings are displayed. Likewise, selection of other rider profile tabs (705) will allow a user to switch to, for example, Rider 2 or Rider 3's information and other settings. Once a tab is selected, a user may enter or update information with regard to a rider (FIG. 2, 195) including, for example, the rider's name, username, age, height, and weight, among others. The username may be any series of characters used to identify the rider in an application, including an application run over a network. The rider information (706) not only identifies the rider (FIG. 2, 195), but also may allow the towrope winch application (FIGS. 12 and 13, 745) to apply a number of statistics in determining the performance or skill level of the rider (FIG. 2, 195). For example, the rider's (FIG. 2, 195) age, height, and weight may be used by the towrope winch application (FIGS. 12 and 13, 745) in determining how the tow system (FIG. 4, 100) and watercraft (FIG. 2, 191) may function. In one exemplary embodiment, the rider information (706) may be used to limit certain parameters such as the maximum and minimum length of the towrope (FIG. 4, 149), the acceleration and speed of towrope (FIG. 4, 149) reel-in and reel-out, and the maximum speed of the watercraft (FIG. 2, 191), among others.

The rider profile page (700) may further include rider preferences (710) that allow a rider (FIG. 2, 195) to define preferences for a number of water sports. A number of water sport tabs (711) may be provided and selected by a user to define a number of parameters of each of the water sports. In one embodiment, for example, a tab may be provided for wake boarding, wake surfing, and wake skating. Further, any number of parameters regarding the operation of the tow system (FIG. 4, 100) and watercraft (FIG. 2, 191) may be predefined and/or user-definable.

The rider preference information (712) may vary for each individual water sport. For example, rider preference information (712) defined for wake surfing may include a slower default reel-in speed and lower default reel-in acceleration rate because a rider (FIG. 2, 195) does not utilize quick reel-in speeds and rates of acceleration while wake surfing. A wake surfer simply uses the towrope winch system (FIG. 4, 100) to bring himself to a certain portion of the wake, and not to accelerate over the wake. In contrast, a rider (FIG. 2, 195) who is wake boarding does accelerate over the wake, and therefore, the wake boarding tab (711) may include dynamic and adjustable reel-in speed and acceleration preferences.

In one exemplary embodiment, the rider preference information (712) may include, for example, a starting and ending towrope (FIG. 4, 149) length. The rider (FIG. 2, 195) may choose a starting towrope (FIG. 4, 149) length that allows the rider (FIG. 2, 195) to most easily get up out of the water, or may challenge him or herself by increasing or decreasing the length. Further, the rider (FIG. 2, 195) may choose how close he or she may get to the boat on a given reel-in command by setting a specific towrope (FIG. 4, 149) ending length. This may allow a user to end a towrope (FIG. 4, 149) reel-in circuit at a specific point of the wake or at a certain distance from the watercraft (FIG. 2, 191).

Further, the rider preference information (712) may further include rider preferences (710) that allow a rider (FIG. 2, 195) to define the minimum and maximum towrope (FIG. 4, 149) length. Thus, a user may limit the overall distances between which the towrope (FIG. 4, 149) may reel in or reel out. In one exemplary embodiment, these preferences may be predefined based on the length of the towrope (FIG. 4, 149) and the distance from the tower (FIG. 2, 131) to the back of the watercraft (FIG. 2, 191). More specifically, in one exemplary embodiment, the minimum towrope length may be defined based on the distance from the towrope winch (FIG. 3, 101) and any back portion of the watercraft (FIG. 2, 191) including the swim deck or moving parts of the watercraft such as those associated with an inboard, outboard, or inboard/outboard motor.

Still further, the rider preference information (712) may further include rider preferences (710) that allow a rider (FIG. 2, 195) to define the reel-in and reel-out speed of the towrope winch (FIG. 3, 101) as well as the reel-in and reel-out rates of acceleration of the towrope winch (FIG. 3, 101). For example, the reel-in speed may be set at 10 ft/sec. and the reel-in acceleration may be 2.5 ft/sec$^2$. The reel-out speed and acceleration may be defined at lower rates such that the rider (FIG. 2, 195) does not loose so much forward velocity that the board (FIG. 2, 197) ceases to plane over the water or otherwise disrupt the rider's (FIG. 2, 195) ability to stay on the board (FIG. 2, 197). Any units may be used in defining these speeds and rates of acceleration.

Still further, the rider preference information (712) may further include rider preferences (710) that allow a rider (FIG. 2, 195) to define a ramp-up and ramp-down (not shown) of the towrope winch (FIG. 3, 101). For example, the ramp-up may be any predetermined or user-defined time interval between the initial pressing of the reel-in button (FIGS. 4, 9, and 10, 161) and obtainment of the reel-in speed described above. Similarly, the ramp-down may be any predetermined or user-defined time interval between the initial pressing of reel-out button (FIGS. 4, 9, and 10, 163) and obtainment of the reel-out speed described above. Any units may be used in defining the ramp-up and ramp-down including seconds and minutes.

Finally, the rider preference information (712) may further include rider preferences (710) that allow a rider (FIG. 2, 195) to define an acceleration profile (not shown). For example, a user may wish to have varying rates of acceleration throughout the reel-in and reel-out acceleration periods. Therefore, a rider may define, for example, a slower acceleration at the beginning of the reel-in acceleration period, and a faster acceleration as the end of the reel-in acceleration period.

The rider profile page (700) may further include a new water sport button (713). The new water sport button (713) may be configured to allow a user to add a new water sport to the selectable water sport tabs (711). In one exemplary embodiment, as the user presses the new water sport button (713), a list of water sports may be presented to the user for selection. Thus, in this embodiment, the type of water sport that may be added is predefined. However, in other embodiments, the user may define a new water sport and define a number of rider preference information (712) for the new water sport.

As depicted in FIG. 14, the rider profile page (700) may also include a new rider button (720). The new rider button (720) may be configured to allow a user to add a new rider profile to the selectable rider profile tabs (705). In one exemplary embodiment, as the user presses the new rider button (720), the user may be prompted to enter information regarding the new rider including the rider information (706) discussed above. Further, a user may be prompted to then select or define a number of water sports that are to be added to the new rider profile as discussed above in connection with the rider preferences (710).

The rider profile page (700) may include a skill level slider (715). In one exemplary embodiment, the value displayed by skill level slider (715) may be user-definable. In this embodiment, the user may simply slide the toggle of the skill level slider (715) to a position in the scale that reflects the user's skill level. As depicted in FIG. 14, the scale may include a ranking of numbers or classifications that assist the user in determining his or her skill level. For example, in one embodiment, a scale of one through ten may be presented to the user. In another exemplary embodiment, words such as "expert," "intermediate," or "novice" may be presented to the user.

In one exemplary embodiment, when the user sets the skill level slider (715) at a level, the rider preference information (712) may be set at a default level corresponding to that level set by the user. For example, if a user sets the skill level slider (715) at "9," the values presented in the rider preference information (712) may default to a level of difficulty that would be expected for a rider with a skill level of "9" in that particular water sport. A default button (716) may be provided, wherein the user may press the default button (716) after entering a skill level slider (715) value, and the rider preference information (712) may be set to a default level corresponding to that level set by the user. In this embodiment, these default rider preference information (712) values may be an average of values set by a number of other riders. A number of algorithms may be employed in determining the default rider preference information (712) values. Further, in this embodiment, the user may be prohibited from changing the value of the skill level slider (715) to a certain degree or standard deviation. For example, a user may be prohibited from changing his or her skill level value reflected on the skill level slider (715) from a "2" to a "6."

In yet another exemplary embodiment, the rider preference information (712) may be defined by the user independent from the value set on the skill level slider (715). In this embodiment, the user may simply use the skill level slider (715) as a means to convey his or her skill level.

In yet another embodiment, the value displayed by skill level slider (715) may be dependant upon the values entered for the rider preference information (712). In this embodiment, a user may enter values in the various parameters of the rider preference information (712), and the skill level slider (715) may automatically be set to a value based on those values entered. Further, a skill level button (717) may be provided, wherein the user may press the skill level button (717) after entering in values for the rider preference information (712), and the skill level slider (715) may automatically be set to a value based on those values entered. For example, if the user enters values in the rider preference information (712) that indicate he or she is an expert level rider, then the skill level slider (715) would adjust to reflect an expert level. This embodiment may also employ a number of algorithms to determine the rider's skill level based on the values entered in for the rider preference information (712).

As depicted in FIG. 14, the rider profile page (700) may further include a sync to computer button (721), a sync to web page button (722), and a save button (723). Each of these buttons will now be described in more detail. First, the sync to computer button (721) may be provided so that a user may copy and/or save information inputted into the rider profile page (700) on a computing device. In one exemplary embodiment, the information inputted into the rider profile page (700) may be transferred to an attached or remote computing device such as a desktop computer, laptop computer, or server, among others. In this manner, a user may document and save changes to the information inputted to the rider profile page (700).

The rider profile page (700) may further include the sync to web page button (722). As similarly discussed above in connection with the sync to computer button (721), the sync to web page button (722) may be provided so that a user may copy and/or save information inputted into the rider profile page (700) to a number of web pages. These web pages may be those web pages discussed above in connection with the user interface (200) of FIGS. 12 and 13.

The save button (723) of FIG. 14 may be provided to a user so that a user may copy and/or save information inputted into the rider profile page (700) to the user interface (FIGS. 12 and 13, 200). Therefore, even if a connection to a computing device or a network is not available, the user may retain the information inputted to the rider profile page (700), and may later upload this information to a computing device or web pages after being able to configure such a connection.

Figure 15:
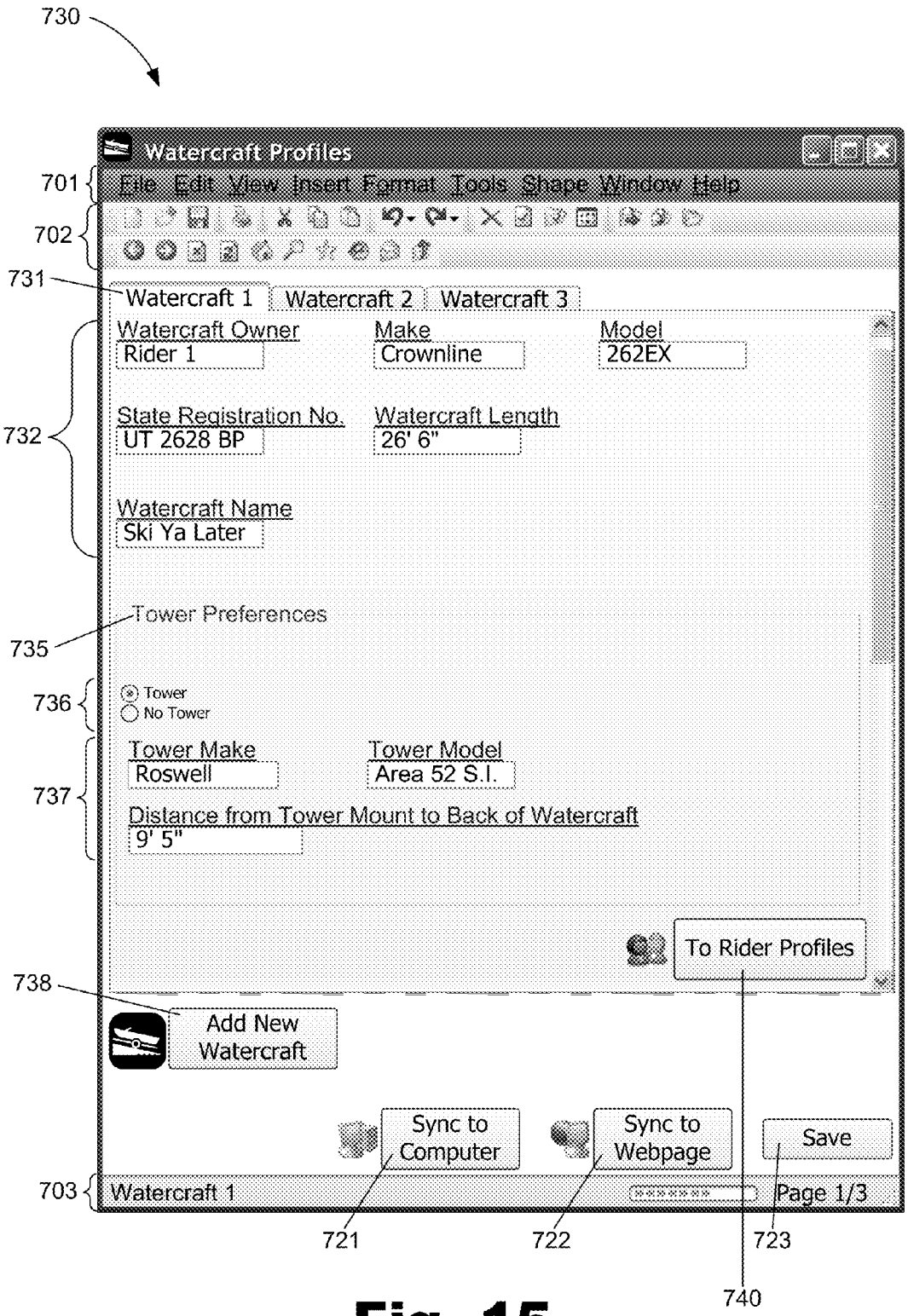
FIG. 15 is a diagram of a watercraft profile page of a towrope winch application according to an embodiment of the present exemplary system and method.

Finally, as depicted in FIG. 14, the rider profile page (700) may include a watercraft profiles button (725). The watercraft profiles button (725) provides a link to the watercraft profile page (730) of FIG. 15. Thus, when a user activates the watercraft profiles button (725), the towrope winch application (FIGS. 12 and 13, 745) may be configured to open the watercraft profile page (FIG. 15, 730). The watercraft profile page (FIG. 15, 730) will now be discussed in more detail below.

Based on the information inputted into the rider profile page (700), a rider (FIG. 2, 195) may then operate the transmitter assembly (FIGS. 4, 9, and 10, 160) while riding behind the watercraft (FIG. 2, 191). By operating the transmitter assembly (FIGS. 4, 9, and 10, 160) in conjunction with the information inputted to the rider profile page (700), a rider (FIG. 2, 195) can more fully control his or her ride.

FIG. 15 is a diagram of a watercraft profile page (730) of a towrope winch application (FIGS. 12 and 13, 745) according to an embodiment of the present exemplary system and method. As similarly discussed above in connection with the rider profile page (700) of FIG. 14, the watercraft profile page (730) may include a menu bar (701), a toolbar (702), and a status bar (703). The menu bar (701) may include any window or application specific menus that provide access to such functions as opening files, interacting with an application, or help resources. The toolbar (702) may include any number of buttons, icons, or other input or output elements for carrying out the various functions of the towrope winch application (FIGS. 12 and 13, 745). Finally, the status bar (703) may be configured to display any information about the current state of the watercraft profile page (730) including tabs currently being viewed, progress of a task, such as a download or file transfer, and a page currently being viewed, among others.

As depicted in FIG. 15, the watercraft profile page (730) may include a number of watercraft profile tabs (731). The watercraft profile tabs (731) are configured to allow a user to switch between different watercraft profiles. As depicted in FIG. 15, the Watercraft 1 tab is selected. Thus, Watercraft 1's information and other settings are displayed. Likewise, selection of other watercraft profile tabs (731) will allow a user to switch to, for example, information and other settings in connection with Watercraft 2 or Watercraft 3. Once a tab is selected, a user may enter or update the watercraft information (732) with regard to a watercraft (FIG. 2, 191) including, for example, the owner of the watercraft (FIG. 2, 191), the make and model of the watercraft (FIG. 2, 191), a state registration number of the watercraft (FIG. 2, 191), the watercraft's (FIG. 2, 191) dimensions such as its length, and the watercraft's (FIG. 2, 191) name, among others. The information placed in for the watercraft owner may be the name of any person who is tied to that particular watercraft through ownership or other means.

The registration number of the watercraft (FIG. 2, 191) may include any government or privately issued watercraft registration number. In one exemplary embodiment, the towrope winch application (FIGS. 12 and 13, 745) may be provided with a look-up table that includes a list of registration numbers for a number of watercraft (FIG. 2, 191) and corresponding details of each watercraft (FIG. 2, 191). In this embodiment, a user may enter a watercraft (FIG. 2, 191) registration number into the watercraft profile page (730), and the towrope winch application (FIGS. 12 and 13, 745) may be configured to automatically enter information in a number of fields with regard to that watercraft (FIG. 2, 191). For example, after a user enters a watercraft (FIG. 2, 191) registration number into the watercraft profile page (730), the towrope winch application (FIGS. 12 and 13, 745) may automatically enter corresponding information regarding the watercraft (FIG. 2, 191) owner, the make of the watercraft (FIG. 2, 191), the model of the watercraft (FIG. 2, 191), the length of the watercraft (FIG. 2, 191), the name of the watercraft (FIG. 2, 191), or other information, in their respective fields.

The make and model of the watercraft (FIG. 2, 191) may be provided in the watercraft profile page (730) not only to identify the watercraft, but for use in connection with the rider preferences (FIG. 14, 710) of the rider profile page (FIG. 14, 700). In one exemplary embodiment, the watercraft's (FIG. 2, 191) dimensions and features may be used by the towrope winch application (FIGS. 12 and 13, 745) in determining how the tow system (FIG. 4, 100) may function or operate. In this embodiment, the make and model of the watercraft (FIG. 2, 191) may be used to limit certain parameters such as the maximum and minimum length of the towrope (FIG. 4, 149), the acceleration and speed of towrope (FIG. 4, 149) reel-in and reel-out, and the maximum speed of the watercraft (FIG. 2, 191), among others. For example, the make and model of the watercraft may be used in determining whether the watercraft (FIG. 2, 191) has a swim deck. For example, the towrope winch application (FIGS. 12 and 13, 745) may be provided with a look-up table that includes a list of makes and models for a number of watercraft (FIG. 2, 191) and corresponding details of each watercraft (FIG. 2, 191). In this embodiment, a user may enter a make and model of a watercraft (FIG. 2, 191) into the watercraft profile page (730), and the towrope winch application (FIGS. 12 and 13, 745) may be configured to automatically enter information in a number of fields with regard to that watercraft (FIG. 2, 191). For example, this information may be used in determining the minimum length of the towrope (FIG. 4, 149), and the minimum length of the towrope (FIG. 4, 149) may be entered into the rider preferences (FIG. 14, 710) of the rider profile page (FIG. 14, 700) as a default value. This embodiment may also employ a number of algorithms to determine the operating parameters of the tow system (FIG. 4, 100) based on the values entered in for the watercraft information (732).

The watercraft profile page (730) may further include tower preferences (735). The tower preferences (735) may include, for example, a tower radio button (736) and tower information (737). The tower radio button (735) may be provided to allow a user to indicate whether the watercraft (FIG. 2, 191) does or does not have a tower (FIG. 2, 131). If the watercraft (FIG. 2, 191) does have a tower (FIG. 2, 131) as depicted in FIG. 15, then the tower information (737) may appear or otherwise become active. The user may then enter or update the tower information (737) with regard to the tower (FIG. 2, 131) including, for example, the make and model of the tower (FIG. 2, 131), and the distance from the tow knob (FIG. 2, 132) of the tower (FIG. 2, 131) to the back of the watercraft (FIG. 2, 191).

In one exemplary embodiment, the towrope winch application (FIGS. 12 and 13, 745) may be provided with a look-up table that includes a list of makes and models of a number of towers (FIG. 2, 131), and corresponding details of each tower (FIG. 2, 131). In this embodiment, a user may enter a make and model of a tower (FIG. 2, 131) into the watercraft profile page (730). Based on the information in the look-up table, the towrope winch application (FIGS. 12 and 13, 745) may be configured to automatically enter information in a number of fields with regard to that tower (FIG. 2, 131) including the distance from the tower mount to the back of the watercraft (FIG. 2, 191).

The distance from the tow knob (FIG. 2, 132) of the tower (FIG. 2, 131) (or other point at which the towrope winch (FIG. 3, 101) is mounted) to the back of the watercraft (FIG. 2, 191) may be used in determining the minimum length of the towrope (FIG. 4, 149). This determination may be made in addition to or separate from the determination as to the watercraft's (FIG. 2, 191) dimensions and features discussed above. The minimum length of the towrope (FIG. 4, 149) may be entered into the rider preferences (FIG. 14, 710) of the rider profile page (FIG. 14, 700) as a default value. This embodiment may also employ a number of algorithms to determine the operating parameters of the tow system (FIG. 4, 100) based on the values entered in for the tower preferences (735).

As depicted in FIG. 15, the watercraft profile page (700) may also include a new watercraft button (738). The new watercraft button (738) may be configured to allow a user to add a new watercraft profile to the selectable watercraft profile tabs (731). In one exemplary embodiment, as the user presses the new watercraft button (731), the user may be prompted to enter information regarding the new watercraft including the watercraft information (732) discussed above.

As depicted in FIG. 15, the watercraft profile page (730) may further include a sync to computer button (721), a sync to web page button (722), and a save button (723) as similarly described above in connection with the rider profile page (700) of FIG. 14. The sync to computer button (721) may be provided so that a user may copy and/or save information inputted into the watercraft profile page (730) on a computing device. In one exemplary embodiment, the information inputted into the watercraft profile page (730) may be transferred to an attached or remote computing device such as a desktop computer, laptop computer, or server, among others. In this manner, a user may document and save changes to the information inputted to the watercraft profile page (730).

The watercraft profile page (730) may further include the sync to web page button (722). As similarly discussed above in connection with the sync to computer button (721), the sync to web page button (722) may be provided so that a user may copy and/or save information inputted into the watercraft profile page (730) to a number of web pages. These web pages may be those web pages discussed above in connection with the user interface (200) of FIGS. 12 and 13.

The save button (723) of FIG. 15 may be provided to a user so that a user may copy and/or save information inputted into the watercraft profile page (730) to the user interface (FIGS. 12 and 13, 200). Therefore, even if a connection to a computing device or a network is not available, the user may still retain the information inputted to the watercraft profile page (730), and may later upload this information to a computing device or web pages after being able to configure such a connection.

Finally, as depicted in FIG. 15, the watercraft profile page (730) may include a rider profiles button (740). The rider profiles button (740) provides a link to the rider profile page (700) of FIG. 14. Thus, when a user activates the rider profiles button (740), the towrope winch application (FIGS. 12 and 13, 745) may be configured to open the rider profile page (FIG. 14, 700).

Figure 16:
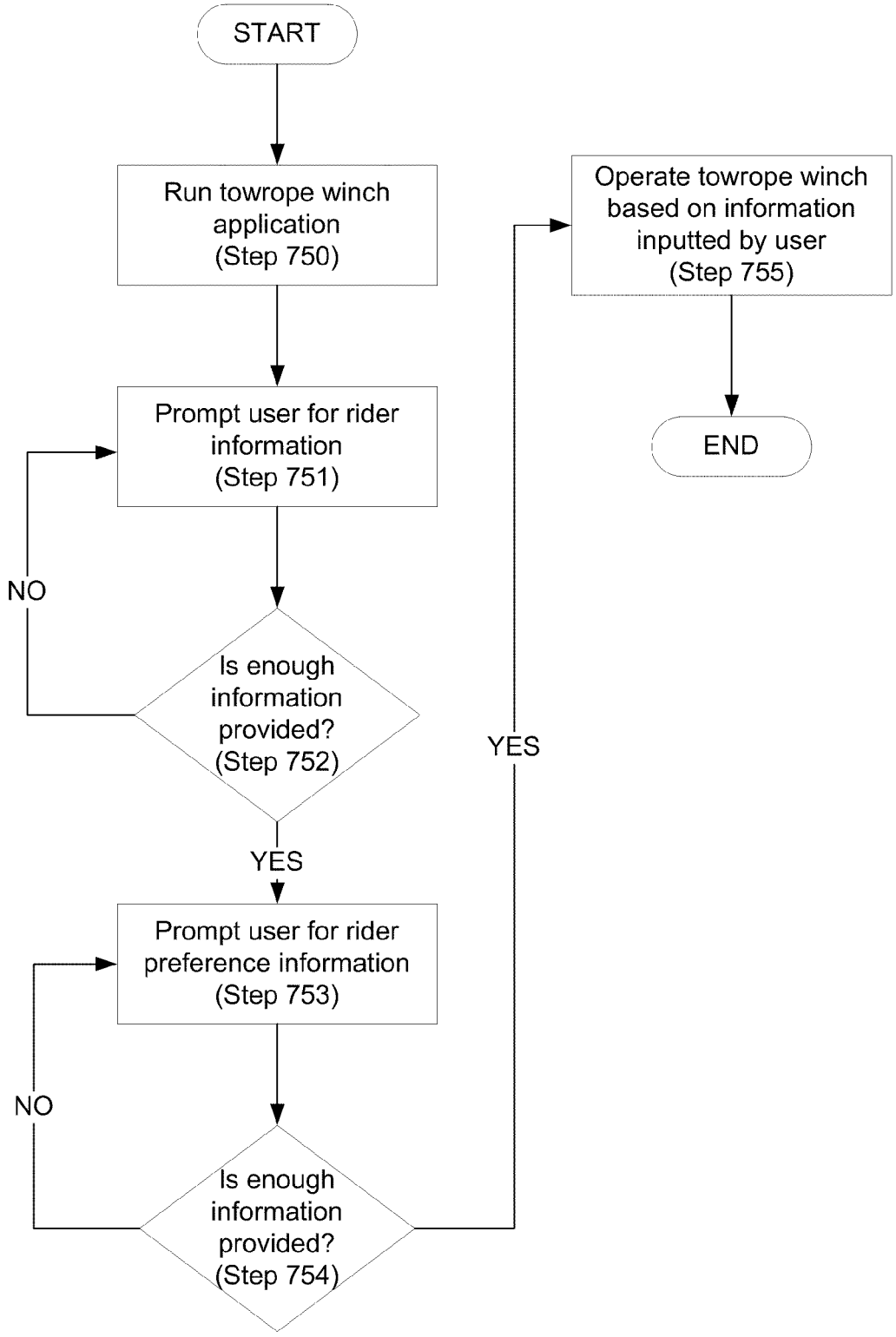
FIG. 16 is a flow chart depicting a process for defining operating parameters of a towrope winch according to an embodiment of the present exemplary system and method.

FIG. 16 is a flow chart depicting a process for defining operating parameters of a towrope winch (FIG. 3, 101) according to an embodiment of the present exemplary system and method. The process begins by running the towrope winch application (FIGS. 12 and 13, 745) (Step 750), and, more specifically, opening a rider profile page (FIG. 14, 700) of the towrope winch application (FIGS. 12 and 13, 745). This may be performed automatically when the tow system (FIG. 4, 100) is first activated, or may be initiated by a user. As discussed above, the towrope winch application (FIGS. 12 and 13, 745) may be run on any computing device including, for example, a computing device contained in, or coupled to the tow system (FIG. 4, 100), the watercraft (FIG. 2, 191), a user interface (FIGS. 11, 12, and 13, 200), a network, or combinations thereof.

Next, the towrope winch application (FIGS. 12 and 13, 745) may prompt a user for rider information (FIG. 14, 706) (Step 751). The user may then enter information for a number of required and optional fields in connection with the rider information (FIG. 14, 706). The towrope winch application (FIGS. 12 and 13, 745) may then determine whether enough rider information (FIG. 14, 706) has been provided (Step 752). In one exemplary embodiment, required fields may include the name of the rider, a username of the rider, and the height and weight of the rider. Optional fields may include the age and sex of the rider. If enough rider information (FIG. 14, 706) has not been provided (Step 752, determination NO), then the towrope winch application (FIGS. 12 and 13, 745) may again prompt a user for rider information (FIG. 14, 706). This process may be performed for any number of iterations until enough rider information (FIG. 14, 706) has been provided.

If enough rider information (FIG. 14, 706) has been provided (Step 752, determination YES), then the towrope winch application (FIGS. 12 and 13, 745) may prompt a user for rider preference information (FIG. 14, 712) (Step 753). The user may then enter information for a number of required and optional fields in connection with the rider preference information (FIG. 14, 712). The towrope winch application (FIGS. 12 and 13, 745) may then determine whether enough rider preference information (FIG. 14, 712) has been provided (Step 754). In one exemplary embodiment, required fields may include a minimum towrope (FIG. 4, 149) length, a reel-in towrope winch (FIG. 3, 101) speed, and a reel-in towrope winch (FIG. 3, 101) acceleration. Optional fields may include a starting towrope (FIG. 4, 149) length, an ending towrope (FIG. 4, 149) length, a maximum towrope (FIG. 4, 149) length, a reel-out towrope winch (FIG. 3, 101) speed, and a reel-out towrope winch (FIG. 3, 101) acceleration.

If enough rider preference information (FIG. 14, 712) has not been provided (Step 754, determination NO), then the towrope winch application (FIGS. 12 and 13, 745) may again prompt a user for rider preference information (FIG. 14, 712). This process may be performed for any number of iterations until enough rider preference information (FIG. 14, 712) has been provided. If enough rider preference information (FIG. 14, 712) has been provided (Step 754, determination YES), then the towrope winch application (FIGS. 12 and 13, 745) may be configured to send instructions to the towrope winch (FIG. 3, 101) or otherwise control the towrope winch (FIG. 3, 101) such that the towrope winch (FIG. 3, 101) operates based on the information inputted by the user (Step 755).

Figure 17:
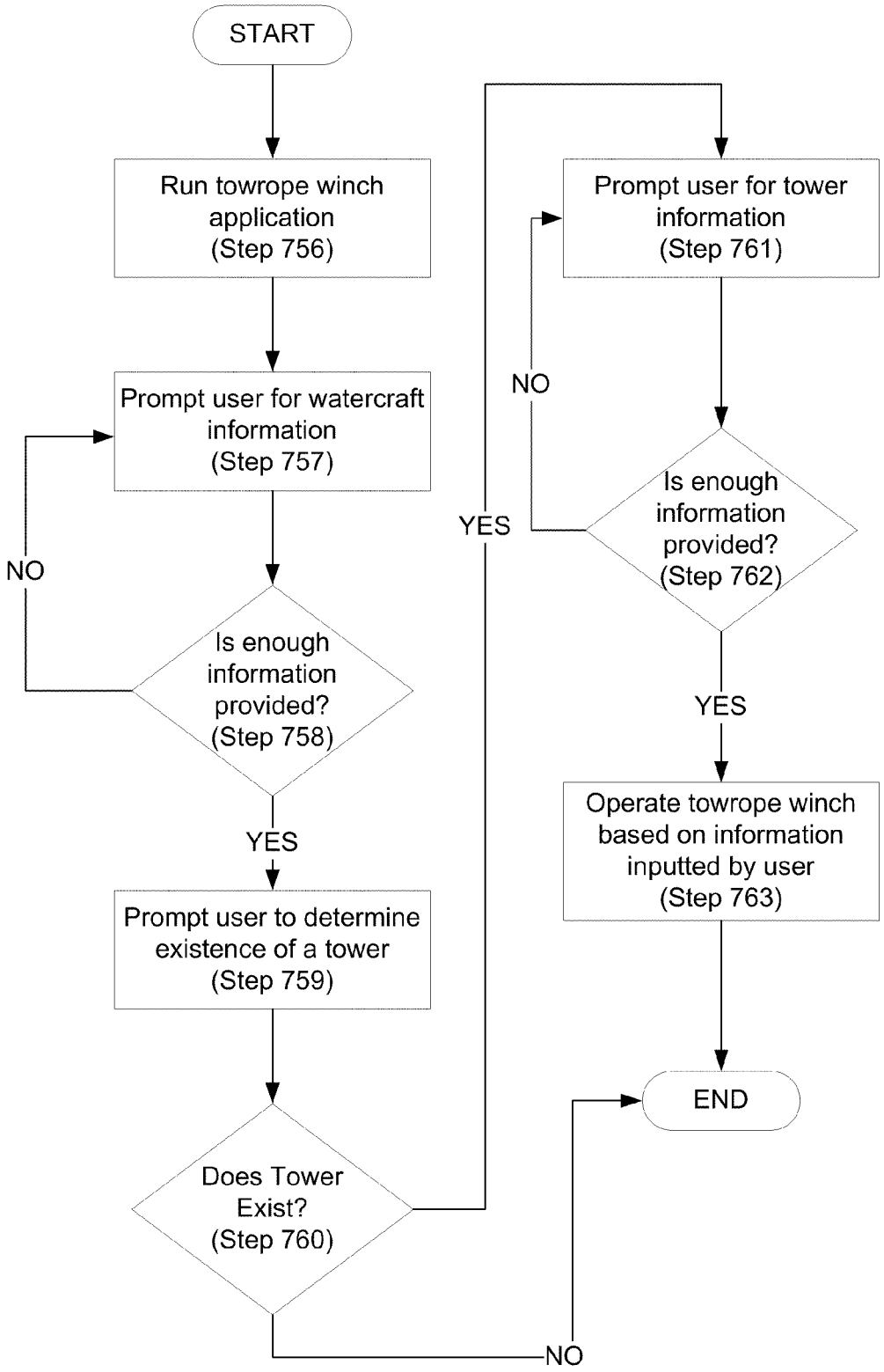
FIG. 17 is a flow chart depicting a process for defining operating parameters of a towrope winch according to another embodiment of the present exemplary system and method.

FIG. 17 is a flow chart depicting a process for defining operating parameters of a towrope winch (FIG. 3, 101) according to another embodiment of the present exemplary system and method. The process begins by running the towrope winch application (FIGS. 12 and 13, 745) (Step 750), and, more specifically, opening a watercraft profile page (FIG. 15, 730) of the towrope winch application (FIGS. 12 and 13, 745). This may be performed automatically when the tow system (FIG. 4, 100) is first activated, or may be initiated by a user. As discussed above, the towrope winch application (FIGS. 12 and 13, 745) may be run on any computing device including, for example, a computing device contained in, or coupled to the tow system (FIG. 4, 100), the watercraft (FIG. 2, 191), a user interface (FIGS. 11, 12, and 13, 200), a network, or combinations thereof.

Next, the towrope winch application (FIGS. 12 and 13, 745) may prompt a user for watercraft information (FIG. 15, 732) (Step 757). The user may then enter information for a number of required and optional fields in connection with the watercraft information (FIG. 15, 732). The towrope winch application (FIGS. 12 and 13, 745) may then determine whether enough watercraft information (FIG. 15, 732) has been provided (Step 758). In one exemplary embodiment, required fields may include a state registration number of the watercraft (FIG. 2, 191), the make and model of the watercraft (FIG. 2, 191), and the watercraft's (FIG. 2, 191) dimensions such as its length, among others.

Optional fields may include the owner of the watercraft (FIG. 2, 191), and the watercraft's (FIG. 2, 191) name, among others. If enough watercraft information (FIG. 15, 732) has not been provided (Step 758, determination NO), then the towrope winch application (FIGS. 12 and 13, 745) may again prompt a user for watercraft information (FIG. 15, 732). This process may be performed for any number of iterations until enough watercraft information (FIG. 15, 732) has been provided.

If enough watercraft information (FIG. 15, 732) has been provided (Step 758, determination YES), then the towrope winch application (FIGS. 12 and 13, 745) may prompt a user to determine if a tower (FIG. 2, 131) is coupled to the watercraft (FIG. 2, 191) (Step 759). Based on the user's input, the towrope winch application (FIGS. 12 and 13, 745) determines if a tower (FIG. 2, 131) is coupled to the watercraft (FIG. 2, 191) (Step 760). If a tower (FIG. 2, 131) is not coupled to the watercraft (FIG. 2, 191) (Step 760, determination NO), then the process ends.

If a tower (FIG. 2, 131) is coupled to the watercraft (FIG. 2, 191) (Step 760, determination YES), then the towrope winch application (FIGS. 12 and 13, 745) may prompt a user for tower information (FIG. 15, 737) (Step 761). The user may then enter information for a number of required and optional fields in connection with the tower information (FIG. 15, 737). The towrope winch application (FIGS. 12 and 13, 745) may then determine whether enough tower information (FIG. 15, 737) has been provided (Step 762). In one exemplary embodiment, required fields may include the distance from the tower mount to the back of the watercraft (FIG. 2, 191). Optional fields may include the make and model of the tower (FIG. 2, 131).

If enough tower information (FIG. 15, 737) has not been provided (Step 762, determination NO), then the towrope winch application (FIGS. 12 and 13, 745) may again prompt a user for tower information (FIG. 15, 737). This process may be performed for any number of iterations until enough tower information (FIG. 15, 737) has been provided. If enough tower information (FIG. 15, 737) has been provided (Step 762, determination YES), then the towrope winch application (FIGS. 12 and 13, 745) may be configured to send instructions to the towrope winch (FIG. 3, 101) or otherwise control the towrope winch (FIG. 3, 101) such that the towrope winch (FIG. 3, 101) operates based on the information inputted by the user (Step 763).

The preceding description has been presented only to illustrate and describe embodiments of the invention. It is not intended to be exhaustive or to limit the invention to any precise form disclosed. Many modifications and variations are possible in light of the above teaching.

What is claimed is:

1. A system for controlling a towrope winch comprising:

a computing device configured to send data to and receive data from the towrope winch, the data sent to the towrope winch operative to control operation of the towrope winch;

the computing device storing rider profile data for each of a plurality of riders, the rider profile data for each of the plurality of riders including at least an identification of the rider, a height of the rider, a weight of the rider, a starting and ending towrope length for the rider, and a ride preference for the each rider;

the computing device configured to execute a towrope winch application and calculate towrope winch operational data for controlling the towrope winch for a particular rider of the plurality of riders, the computing device calculating the towrope winch operational data specific for the particular rider by executing an algorithm on the computing device for calculating the towrope winch operational data, the algorithm using an identification of the particular rider to access the previously stored rider profile data for the particular rider and the algorithm calculating towrope winch operational parameters for controlling the towrope winch for the particular rider using at least the identification of the particular rider, the previously stored rider profile data, the height of the particular rider, the weight of the particular rider, the starting and ending towrope length for the particular rider, the ride preference for the particular rider, and a skill level for the particular rider; and the computing device configured to control operation of the towrope winch by sending from the computing device to the towrope winch the towrope winch operational data which has been calculated by the computing device for the particular rider, wherein functions of the towrope winch are controlled by the calculated operational data without simultaneous user input at the computing device.

2. The system of claim 1, in which the rider profile data comprises one or more of a rider's name, a rider's username, a rider's age, a rider's sex, minimum towrope length, maximum towrope length, reel-in speed of the towrope, reel-out speed of the towrope, reel-in acceleration of the towrope, reel-out acceleration of the towrope, a ramp-up, a ramp-down, an acceleration profile, a rider's skill level, and rider preference information.

3. The system of claim 1, in which the rider profile data is used to determine the skill level of the rider.

4. The system of claim 1, in which the rider profile data comprises a plurality of distinct preferences for a plurality of distinct water sports.

5. The system of claim 4, in which the preferences vary for each water sport.

6. The system of claim 2, in which when the skill level data is entered, the towrope winch application is further configured to define a number of other data.

7. A towrope winch user interface comprising:

a processor configured to send operational data to and receive data from a towrope winch; and a towrope winch application configured to operate with the processor, wherein the processor is configured to operate the towrope winch based on towrope winch operational parameters calculated for a particular rider at least in part from rider profile data input by a user to the towrope winch application and previously stored in computer readable memory, the rider profile data comprising rider information for the particular rider and including at least an identification of the particular rider, a height of the particular rider, a weight of the particular rider, a starting and ending towrope length for the particular rider, and a ride preference for the particular rider, the rider profile data having been input and stored prior to calculation of the operational parameters and operation of the towrope winch, and calculation of the operational parameters based on the stored rider profile data, the height of the particular rider, the weight of the particular rider, the starting and ending towrope length for the particular rider, the ride preference for the particular rider, and a skill level for the particular rider.

8. The towrope winch user interface of claim 7, further comprising a number of input devices for inputting data to the towrope winch user interface.

9. The towrope winch user interface of claim 7, further comprising a number of output devices for outputting information to a user.

10. The towrope winch user interface of claim 7, further comprising a touch screen for inputting data to the towrope winch user interface and outputting information to a user.

11. The towrope winch user interface of claim 7, in which the processor is further configured to operate a watercraft to which the towrope winch is coupled based on data input by the user to the towrope winch application.

12. The towrope winch user interface of claim 7, in which the rider profile data comprises one of a rider's name, a rider's username, a rider's age, minimum towrope length, maximum towrope length, reel-in speed of the towrope, reel-out speed of the towrope, reel-in acceleration of the towrope, reel-out acceleration of the towrope, a ramp-up, a ramp-down, an acceleration profile, a rider's skill level, and combinations thereof.

13. A method for calculating operating parameters for controlling a towrope winch, comprising:

storing rider profile data for each of a plurality of riders, the rider profile data for each of the plurality of riders including at least an identification of the rider, a height of the rider, a weight of the rider, a starting and ending towrope length for the rider, and a ride preference for the each rider;

receiving an identification of a particular rider;

calculating operational parameters for the identified particular rider for the towrope winch by accessing the stored profile data for the particular rider and calculating the operation parameters based on the stored rider profile data, the height of the particular rider, the weight of the particular rider, the starting and ending towrope length for the particular rider, the ride preference for the particular rider, and a skill level for the particular rider;

sending the calculated operational parameters for the particular rider to the towrope winch; and operating the towrope winch based at least in part on the calculated operational parameters.

14. The method of claim 13, in which the rider profile data comprises one of a rider's name, a rider's username, a rider's age, minimum towrope length, maximum towrope length, reel-in speed of the towrope, reel-out speed of the towrope, reel-in acceleration of the towrope, reel-out acceleration of the towrope, a ramp-up, a ramp-down, an acceleration profile, a rider's skill level, and combinations thereof.

15. The method of claim 13, further comprising prompting a user for data regarding a watercraft to which the towrope winch is coupled.

16. The method of claim 15, further comprising operating the watercraft based on data input by the user.

17. The method of claim 15, in which the data regarding a watercraft comprises one of an owner of the watercraft, the make of the watercraft, the model of the watercraft, a registration number of the watercraft, the dimensions of the watercraft, the name of the watercraft, the existence of a tower on the watercraft, the make of the tower, the model of the tower, the distance from a point on the tower to the back of the watercraft, and combinations thereof.

18. A computer program product for calculating operating parameters of a towrope winch, the computer program product comprising:

a non-transitory computer readable data storage device having computer usable program code embodied therewith, the computer usable program code, which when executed upon one or more processors, is configured to:

prompt a user to enter rider profile data, the rider profile data including at least an identification of a rider, a height of the rider, a weight of the rider, a starting and ending towrope length for the rider, and a ride preference for the rider;

receive and store the rider profile data input by the user;

receive an identification for a particular rider;

retrieve stored rider profile data for the particular rider;

calculate operating parameters for the towrope winch specifically for the identified particular rider, wherein calculating the operating parameters is based at least in part upon the retrieved stored rider profile data for the particular rider, the height of the particular rider, the weight of the particular rider, the starting and ending towrope length for the particular rider, the ride preference for the particular rider, and a skill level for the particular rider;

send the calculated operating parameters for the particular rider to the towrope winch; and operate the towrope winch based at least in part upon the calculated operating parameters.

19. The computer program product of claim 18, in which the rider profile data comprises one of a rider's name, a rider's username, a rider's age, minimum towrope length, maximum towrope length, reel-in speed of the towrope, reel-out speed of the towrope, reel-in acceleration of the towrope, reel-out acceleration of the towrope, a rider's skill level, a ramp-up, a ramp-down, an acceleration profile, and combinations thereof.

20. The computer program product of claim 18, further comprising computer usable program code configured to prompt a user for data regarding a watercraft to which the towrope winch is coupled.

* * * * *